US007068965B2

(12) United States Patent
Yoshino et al.

(10) Patent No.: US 7,068,965 B2
(45) Date of Patent: Jun. 27, 2006

(54) DEVELOPING CARTRIDGE, SIDE COVER MOUNTING METHOD AND ELECTROPHOTOGRAPHIC IMAGE FORMING APPARATUS

(75) Inventors: Yasufumi Yoshino, Numazu (JP); Kojiro Yasui, Shizuoka-ken (JP); Koji Yamaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/665,438

(22) Filed: Sep. 22, 2003

(65) Prior Publication Data

US 2004/0114961 A1 Jun. 17, 2004

(30) Foreign Application Priority Data

Sep. 30, 2002 (JP) ..... 2002-286205

(51) Int. Cl.
*G03G 15/04* (2006.01)
*G03G 15/08* (2006.01)

(52) U.S. Cl. ..... 399/119

(58) Field of Classification Search ..... 399/119, 399/111, 120, 114
See application file for complete search history.

(56) References Cited

U.S. PATENT DOCUMENTS

| | | | | |
|---|---|---|---|---|
| 5,966,566 | A | 10/1999 | Odagawa et al. | 399/109 |
| 6,002,898 | A * | 12/1999 | Yokomori et al. | 399/119 |
| 6,603,939 | B1 * | 8/2003 | Toba et al. | 399/103 |
| 2002/0110386 | A1 | 8/2002 | Kanno et al. | 399/111 |
| 2003/0086715 | A1 | 5/2003 | Miura et al. | 399/27 |
| 2003/0086723 | A1 | 5/2003 | Yamaguchi et al. | 399/119 |
| 2004/0086300 | A1 * | 5/2004 | Kawai et al. | 399/167 |
| 2005/0115043 | A1 * | 6/2005 | Maeshima et al. | 29/402.08 |

* cited by examiner

*Primary Examiner*—Quana Grainger
(74) *Attorney, Agent, or Firm*—Fitzpatrick, Cella, Harper & Scinto

(57) ABSTRACT

A developing cartridge detachably mountable to an electrophotographic image forming apparatus. The cartridge includes a frame, a developing roller, a frame groove, a frame projection, a bearing configured and positioned to rotatably support a developing roller shaft, a bearing cylinder, an elongated bearing opening receiving the frame projection, first and second bearing projections, first, second and third screws, a side cover covering the bearing and including a first opening engageable with the first bearing projection and a second opening engageable with the second bearing projection, and a side cover projection engageable with the bearing cylinder. The first screw secures the bearing to the frame, the second screw secures the side cover to the frame and the third screw secures the side cover to the first bearing projection.

22 Claims, 29 Drawing Sheets

DEVELOPING CARTRIDGE, SIDE COVER MOUNTING METHOD AND ELECTROPHOTOGRAPHIC IMAGE FORMING APPARATUS

FIELD OF THE INVENTION AND RELATED ART

The present invention relates to a development cartridge, an electrophotographic image forming apparatus in which a development cartridge is removably mountable, a method for attaching one of the two end covers of a development cartridge, and a method for attaching the other end cover of the development cartridge.

Here, an electrophotographic image forming apparatus means an apparatus for forming an image on a recording medium with using an electrophotographic image formation process. For example, it includes electrophotographic copying machines, electrophotographic printers (LED printers, laser beam printers, etc.), electrophotographic facsimile machines, electrophotographic wordprocessors, etc.

In the field of an image forming apparatus, a development cartridge system, that is, a system in which the developing members for developing an electrostatic latent image formed on the electrophotographic photoconductive member are disposed in a cartridge, which comprises a storage portion for storing developer (which hereinafter will be referred to as "toner"), and which is removably mountable in the main assembly of the image forming apparatus, has been widely employed.

The development cartridge system allows a user to maintain an image forming apparatus without relying on a service person, drastically improving an image forming apparatus in terms of operational efficiency. Thus, the cartridge system has been widely used in the field of an electrophotographic image forming apparatus.

Some of the development cartridges employed by a development cartridge system have been known to use side covers, which are attached to the lengthwise ends of the cartridge frame, one for one (U.S. Pat. No. 5,966,566).

SUMMARY OF THE INVENTION

The present invention is a further development of the prior art described above.

The primary object of the present invention is to provide a development cartridge superior to development cartridges in accordance with the prior art, in terms of the efficiency with which the side covers are attached to a cartridge frame, a method for attaching the side covers, and an electrophotographic image forming apparatus.

Another object of the present invention is to provide a development cartridge superior to development cartridges in accordance with the prior arts, in terms of the accuracy with which side covers are attached to a cartridge frame, a method for attaching the side covers, and an electrophotographic image forming apparatus.

Another object of the present invention is to provide a development cartridge superior to development cartridges in accordance with the prior art, in terms of how solidly the side covers are attached to a cartridge frame, a method for attaching the side covers, and an electrophotographic image forming apparatus.

Another object of the present invention is to provide a development cartridge, the side covers of which are reinforced by being attached to a cartridge frame, to prevent the side covers from deforming when the position of the development cartridge relative to the main assembly of an electrophotographic image forming apparatus is fixed by a part of each side cover when the development cartridge is mounted into the main assembly of the image forming apparatus, and thereafter, being therefore superior to development cartridges in accordance with the prior art, in terms of the accuracy with which the development cartridge is positioned relative to the main assembly of an electrophotographic image forming apparatus, a method for attaching the side covers, and an electrophotographic image forming apparatus.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, a development cartridge, an electrophotographic image forming apparatus, a method for attaching one of the side covers, and a method for attaching the other side cover, in accordance with the present invention, will be described in more detail with reference to the appended drawings.

Embodiment 1

Figure 1:
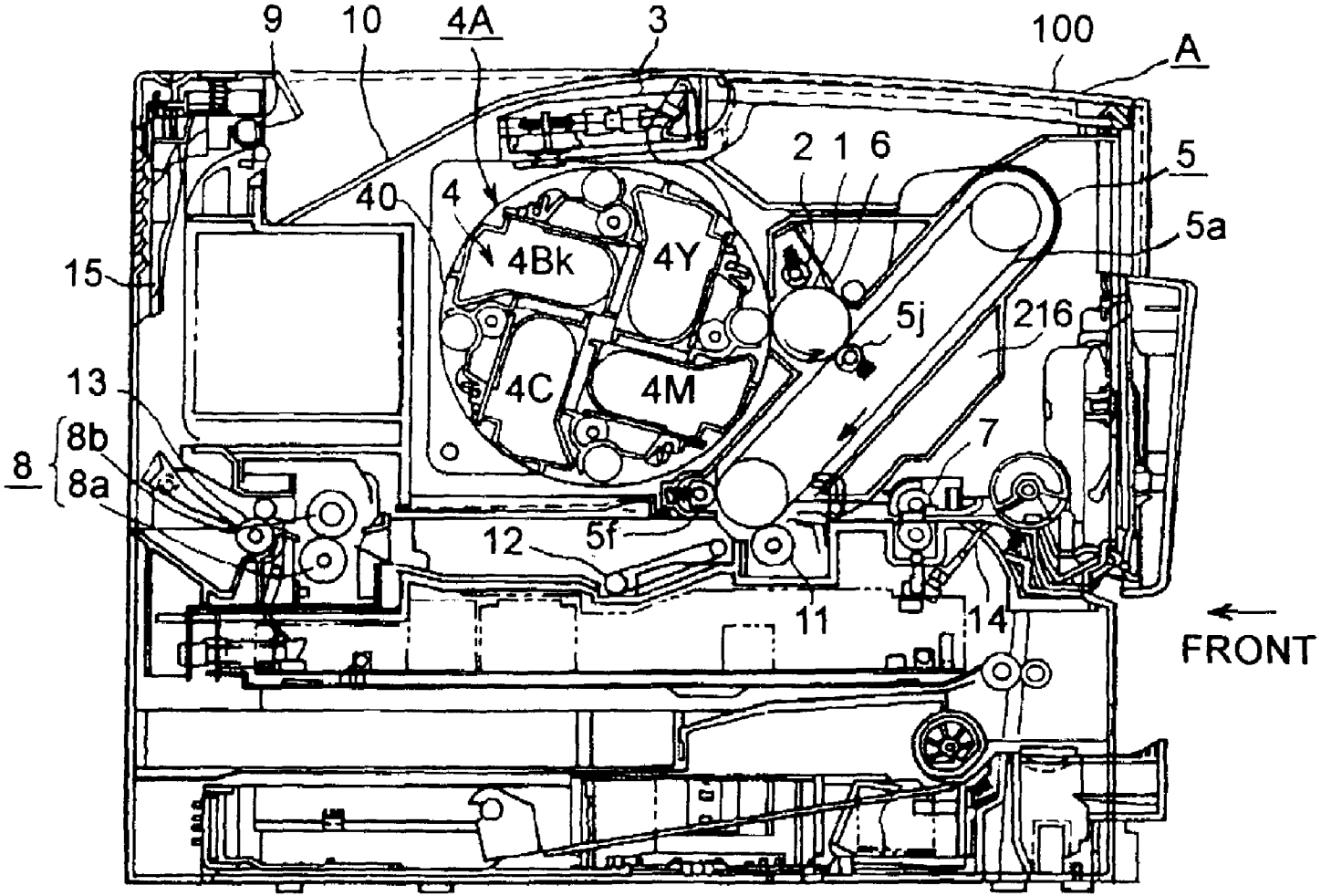
FIG. 1 is a sectional view of the main assembly of an electrophotographic color image forming apparatus in accordance with the present invention.

FIG. 1 shows one of the preferred embodiments of an electrophotographic image forming apparatus, more specifically, a color laser beam printer, in accordance with the present invention. In the following description of this embodiment, the "front side" of the apparatus means the upstream side (right side in FIG. 1) in terms of the direction in which recording medium (transfer medium) is conveyed from the transfer station to the fixation station. The "left or right side" of the main assembly of the apparatus means the left or right side as seen from the front side of the apparatus, and the "left or right side" of a process cartridge means the left or right side of the process cartridge as seen from the front side of the apparatus in the proper position in the main assembly of the apparatus. The "lengthwise direction" is the direction parallel to the surface of the recording medium in the apparatus, and is intersectional (virtually perpendicular) to the direction in which the recording medium is conveyed.

(General Structure of Electrophotographic Color Image Forming Apparatus)

First, the general structure of the electrophotographic color image forming apparatus A will be described with reference to FIGS. 1 and 2.

The color laser beam printer A in this embodiment comprises: four development cartridges 4, more specifically, a yellow component developing device 4Y, a magenta component developing device 4M, a cyan component developing device 4C, and a black component developing device 4Bk; a process cartridge 5 comprising a photoconductive drum unit 20 and an intermediary transfer unit 21; and the main assembly 100 in which the development cartridges 4 and process cartridge 5 are removably mountable.

Referring to FIG. 1, in the image forming apparatus main assembly 100, an optical image formed in accordance with image formation data is projected from an exposing means 3 to form an electrostatic latent image on a photoconductive drum 1 uniformly charged by a charging apparatus 2. The formed latent image is developed into a visible image (which hereinafter may be referred to as "toner image") by one of the development cartridges 4 which make up a part of a developing apparatus 4A. The toner image is transferred onto an intermediary transfer member 5*a* by a first transferring means 5*j* as a transferring apparatus.

The toner image on the intermediary transfer member 5*a* is transferred by a second transferring means 11 onto a recording medium being conveyed by a conveying means in synchronism with the formation of the toner image. Then, the transfer medium is conveyed to a fixing means 8 comprising a pressure roller 8*a* and heat roller 8*b*. In the fixing means 8, the toner image on the transfer medium is permanently fixed to the transfer medium. Thereafter, the recording medium is discharged into a delivery tray 10.

Figure 2:
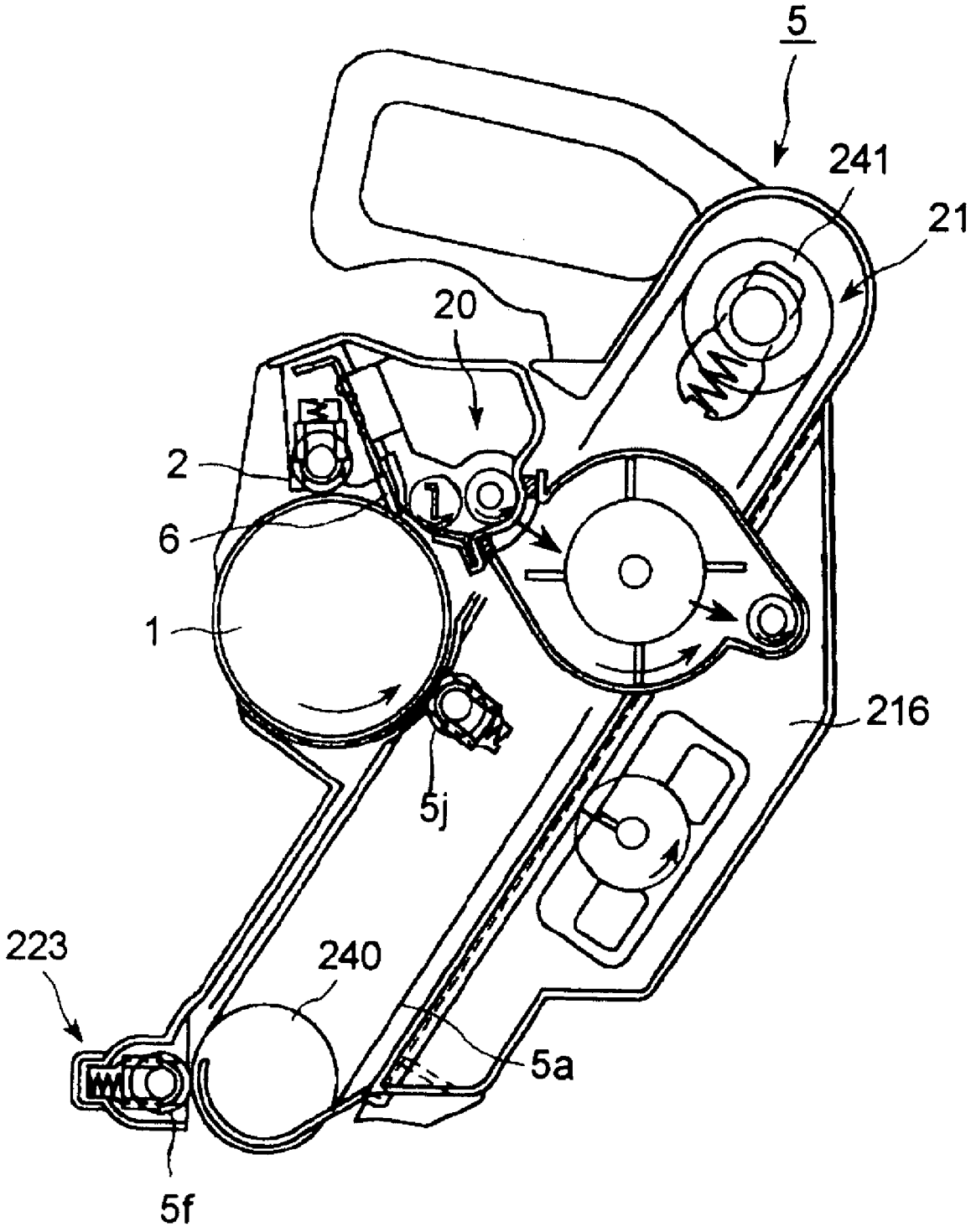
FIG. 2 is a sectional view of the main portion of a process cartridge mountable in an electrophotographic color image forming apparatus in accordance with the present invention.

Next, referring to FIG. 2, in this embodiment, the photoconductive drum 1, an intermediary transfer belt 5*a*, and a waste toner box 216, are integrated in the form of a process cartridge 5, which is made up of two units: photoconductive drum unit 20 which contains the photoconductive drum 1, and an intermediary transfer member unit 21 which contains the intermediary transfer belt 5*a* and waste toner box 216.

The intermediary transfer belt unit 21 has a means (intermediary transferring means) for transferring a toner image from the photoconductive drum 1 onto a recording medium with the use of the intermediary transfer belt 5*a*, and a means (waste toner recovering-storing means) for recovering the waste toner and storing it.

The intermediary transfer belt 5*a* is stretched around two rollers, which are a driver roller 240 and follower roller 241. The process cartridge 5 has a primary transfer roller 5*j*, which is disposed in a manner to oppose the photoconductive drum 1 with the intermediary transfer belt 5*a* interposed.

The process cartridge 5 also has a cleaning charge roller unit 223 for applying a predetermined amount of bias voltage to remove residual electrical charge from the residual toner, which in this case is the toner remaining on the intermediary transfer belt 5*a*. The cleaning charge roller unit 223 is disposed in a manner to oppose the driver roller 240.

The charge roller 5*f* of the cleaning charge roller unit 223 removes the residual electrical charge from the residual toner on the intermediary transfer belt 5*a* by applying the predetermined amount of bias voltage. After the removal of the residual electrical charge, the residual toner is electrostatically transferred back onto the photoconductive drum 1.

Then, the residual toner is removed (recovered) by a cleaning blade 6, and is accumulated in the waste toner box 216 as described before.

Referring again to FIGS. 1 and 2, the image formation process of the image forming apparatus structured as described above will be described in further detail.

The photoconductive drum 1 is rotated in the direction indicated by an arrow mark in FIG. 1 (counterclockwise direction), in synchronism with the rotation of the intermediary transfer belt 5*a*. As a predetermined charge bias voltage is applied to the charge roller 2 as a charging apparatus, the peripheral surface of the photoconductive drum 1 is uniformly charged. Then, the uniformly charged peripheral surface of the photoconductive drum 1 is exposed by an exposing means 3; it is exposed to the optical image, corresponding to, for example, the yellow component, of an intended image. As a result, an electrostatic latent image corresponding to the yellow component of the intended image is formed on the peripheral surface of the photoconductive drum 1.

The exposing means 3 is a means for projecting a beam of light onto the peripheral surface of the photoconductive drum 1 while modulating the beam of light with the image formation information read through an external device or the like. The exposing means 3 comprises a laser diode, a polygon mirror, a scanner motor, a focusing lens, and a deflective mirror.

As image formation signals are given to the exposing means 3 from an external device or the like, the laser diode of the exposing means 3 emits a beam of light in response to the image formation signals. The emitted beam of light is projected as an image forming beam of light onto the polygon mirror, which is being rotated at a high speed by a scanner motor. As a result, the image forming beam of light is reflected by the polygon mirror, and is sent through the focusing lens. Then, it selectively exposes the peripheral surface of the photoconductive drum 1 after being reflected by the deflective mirror. Consequently, an electrostatic latent image is formed on the peripheral surface of the photoconductive drum 1.

The electrostatic latent image on the photoconductive drum 1 is developed into an image formed of toner of a predetermined color (which hereinafter will be simply referred to as toner image). More specifically, the electrostatic latent image is developed by moving a predetermined development cartridge 4 among the four development cartridges 4 to the development position at which the predetermined component developing device opposes the photoconductive drum 1. Incidentally, the four development cartridges 4 mounted in the rotary device 40 in this embodiment are a yellow component developing device 4Y, a magenta component developing device 4M, a cyan component developing device 4C, and a black component developing device 4Bk.

In other words, in this embodiment, as soon as an electrostatic latent image begins to be formed, the predetermined cartridge, for example, the yellow component developing device 4Y, in the developing apparatus 4A is orbitally moved into the development position. Then, a predetermined bias voltage is applied to adhere yellow toner to the electrostatic latent image to develop the electrostatic latent image.

Figure 3:
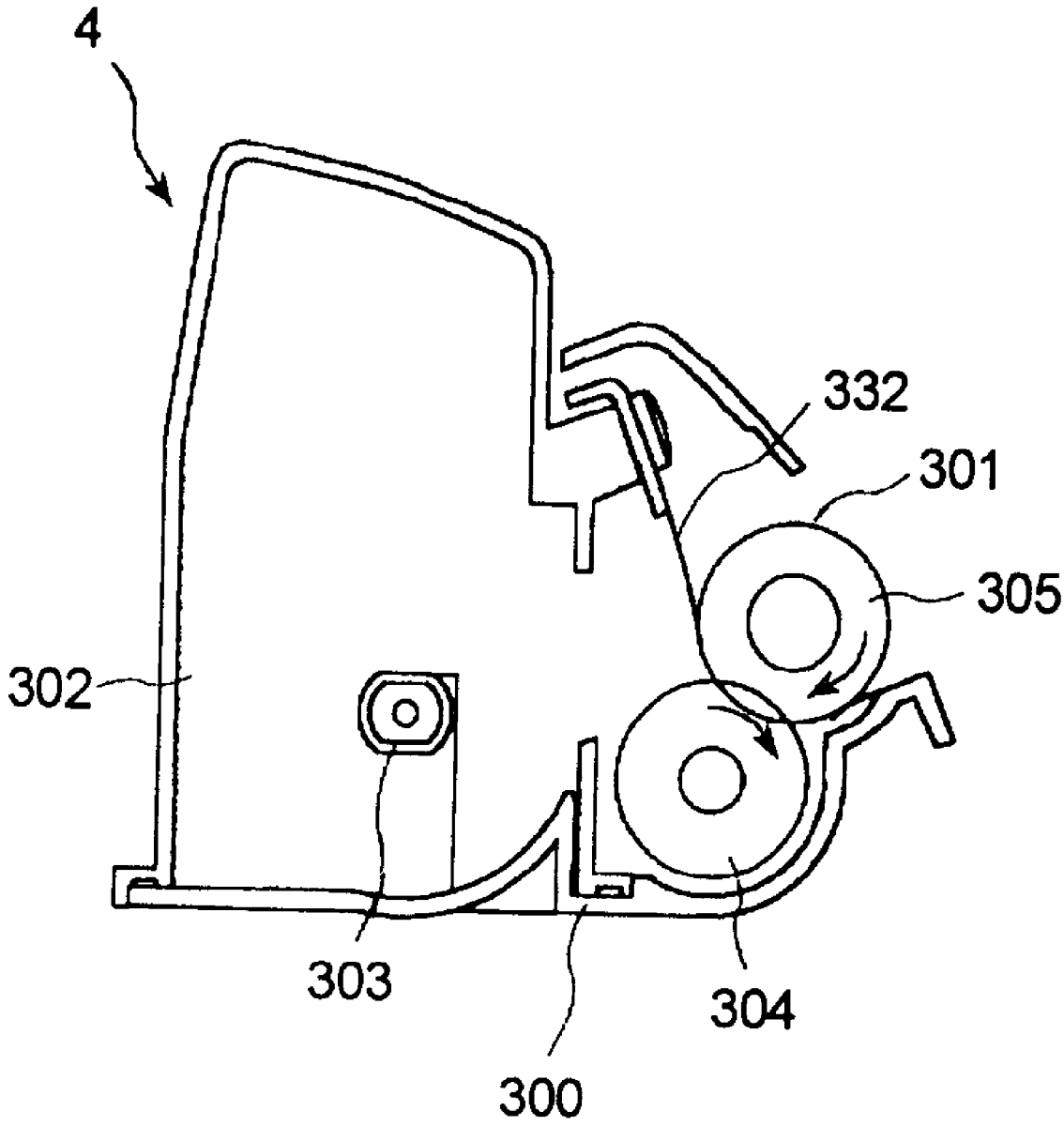
FIG. 3 is a sectional view of the development cartridge in the first embodiment of the present invention.

Referring to FIG. 3, the development cartridge 4 can be roughly divided into two portions: a developer storage portion 302 as a toner container, and a development portion 301 which opposes the electrophotographic photoconductive drum 1. The toner storage portion 302 and development portion 301 are integrally held by the cartridge frame 300.

The toner storage portion 302 is filled with toner of a predetermined color, and is provided with a stirring means 303. As the stirring means 303 is rotated, the toner is conveyed by a predetermined amount to the development portion 301. In the development position 301, the toner is supplied to the peripheral surface of the development roller 305 by the rotation of the toner supply roller 304 (developer supply roller) formed of sponge or like material. After being supplied to the peripheral surface of the development roller 305, the toner is formed into a thin layer of toner by the development blade 332 in the form of a piece of thin plate, while being electrically charged by the friction between the toner and the development blade 332 as well as development roller 305. As the development roller 305 is further rotated, the thin layer portion of the toner on the development roller 305 is conveyed to the development position 301. In the development position 301, the electrostatic latent image on the photoconductive drum 1 is developed by the application of a predetermined development bias.

The toner which did not contribute to the development of the latent image on the photoconductive drum 1, that is, the toner which remained upused on the peripheral surface of the development roller 305, is scraped away by the toner supply roller 304. At the same time as the residual toner is scraped away by the toner supply roller 304, a fresh supply of toner is supplied onto the development roller 305 by the toner supply roller 304 so that the development operation is continuously carried out by the freshly supplied portion of the toner on the development roller 305.

Referring again to FIGS. 1 and 2, after being formed on the photoconductive drum 1, the toner image (yellow toner image) is transferred (primary transfer) onto the intermediary transfer belt 5*a* by the application of bias voltage to a primary transfer roller 5*j*, as a first transfer transferring means, that is, the roller for keeping the intermediary transfer belt 5*a* pressed upon the photoconductive drum 1. The polarity of the bias voltage is opposite to that of the toner.

As the described above primary transfer of the yellow toner image ends, the next color component developing device, which in this embodiment is the magenta component developing device 4M, is orbitally moved into the development position at which it opposes the photoconductive drum 1. Then, the toner image of magenta color is transferred onto the intermediary transfer belt 5*a* through the same process as described above. This process is also carried out for the cyan and black color components. As a result, four toner images different in color are layered on the intermediary transfer belt 5*a*.

While the four toner images are layered on the intermediary transfer belt 5*a*, the secondary transfer roller 11 as a second transferring means, and a cleaning charge roller 5*f* as a cleaning unit, are kept separated from the intermediary transfer belt 5*a*.

After the formation of the four toner images different in color on the intermediary transfer belt 5*a*, the secondary transfer roller 11 is pressed upon the intermediary transfer belt 5*a* as shown in FIG. 1. In addition, in synchronism with the pressing of the secondary transfer roller 11 upon the intermediary transfer belt 5*a*, a recording medium, which has been kept on standby at a predetermined location in the adjacencies of a pair of registration rollers 7 as a transfer medium conveying means, is sent to the nip between the intermediary transfer belt 5*a* and secondary transfer roller 11.

The image forming apparatus is provided with a transfer medium sensor (front sensor) 14, which is disposed on the immediately upstream side of the pair of registration rollers 7 in terms of the transfer medium conveyance direction. The sensor 14 detects the leading edge of the transfer medium, and as it detects the leading edge, it interrupts the conveyance of the force for rotationally driving the pair of registration rollers 7 to the pair of registration rollers 7 in order to keep the recording medium on standby at the predetermined location.

The secondary transfer roller 11 is provided with bias voltage opposite in polarity to the toner. Therefore, as a recording medium is conveyed through the nip, the toner images on the intermediary transfer belt 5*a* are transferred (secondary transfer) all at once onto the surface of the recording medium.

After the secondary transfer of the toner images, the recording medium is conveyed by way of a conveyer belt unit 12 to a fixing device 8, in which the toner images are fixed. Thereafter, the transfer medium is further conveyed by a pair of discharge rollers 13 along a discharge guide 15. Then, the transfer medium is discharged by a pair of discharge rollers 9 into a delivery tray 10 located on top of the color image forming apparatus A. This concludes the image formation.

Meanwhile, the cleaning charge roller 5*f* is pressed upon the intermediary transfer belt 5*a* after the secondary transfer. Then, the residual electrical charge is removed from the surface of the intermediary transfer belt 5*a* and the toner remaining on the intermediary transfer belt 5*a* after the secondary transfer is removed by the application of a predetermined bias voltage.

The residual toner, from which electrical charge has been removed, is electrostatically transferred from the intermediary transfer belt 5*a* onto the photoconductive drum 1, in the primary transfer nip; in other words, the surface of the intermediary transfer belt 5*a* is cleaned.

The toner which remained on the intermediary transfer belt 5*a* after the secondary transfer and has been transferred back onto the photoconductive drum 1 is removed (recovered) from the photoconductive drum 1 by the cleaning blade 6, is conveyed through a specified path (unshown), and is accumulated as waste toner in the waste toner box 216.

(Rotary, Development Cartridge, and Developing Apparatus)

Next, referring to FIGS. 4–13, the development cartridge 4 and developing apparatus 4A will be described.

The four development cartridges 4, that is, yellow component developing device 4Y, magenta component developing device 4M, cyan component developing device 4C, and black component developing device 4Bk, which contain yellow, magenta, cyan, and black toners, one for one, are firmly mounted in their predesignated positions in the rotary device 40 of the developing apparatus 4A, as previously described.

First, the method for positioning each development cartridge 4 relative to the rotary device 40 will be described.

Figure 11:
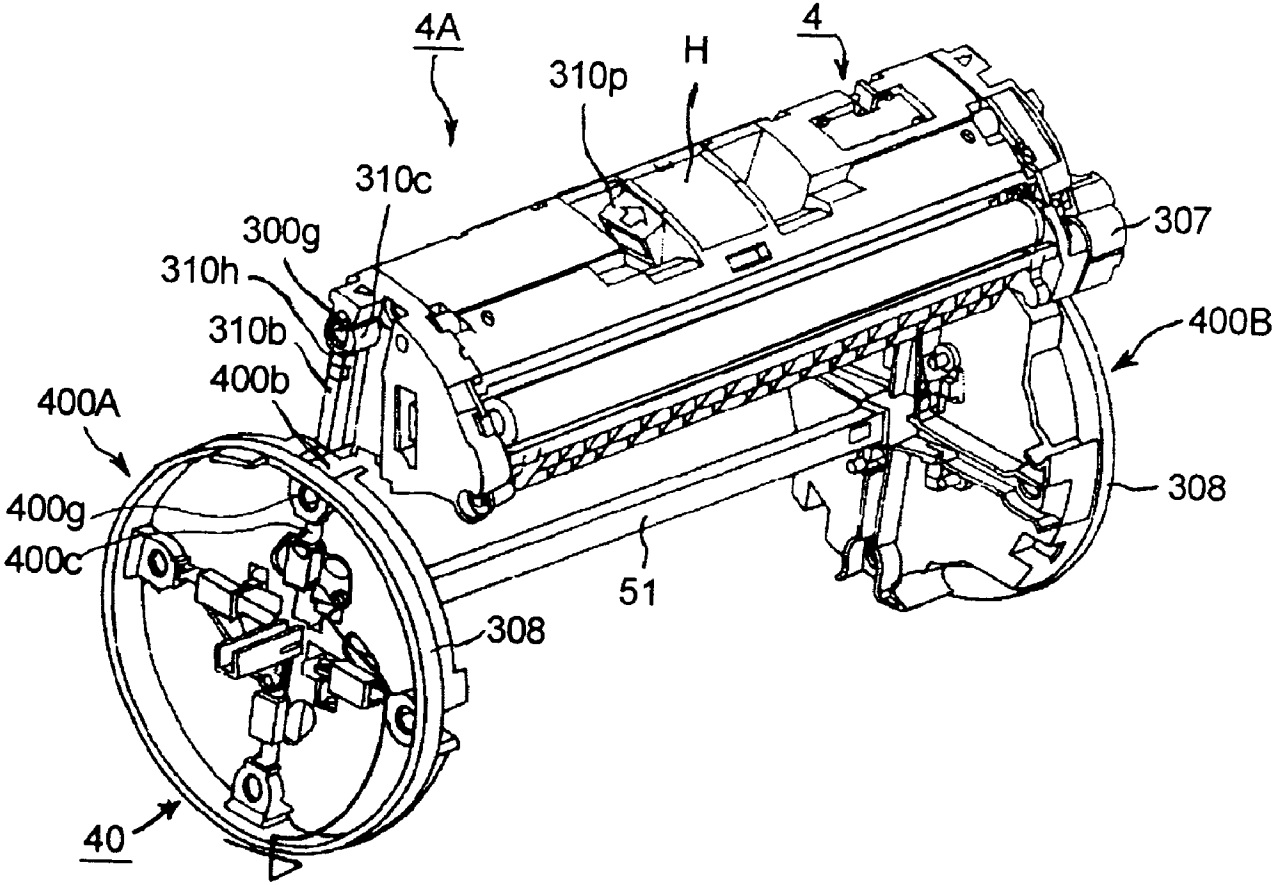
FIG. 11 is a perspective view of a rotary device of the main assembly of the image forming apparatus, and one of the development cartridges, in the first embodiment of the present invention, for showing how the latter is mounted into the former.
Figure 12:
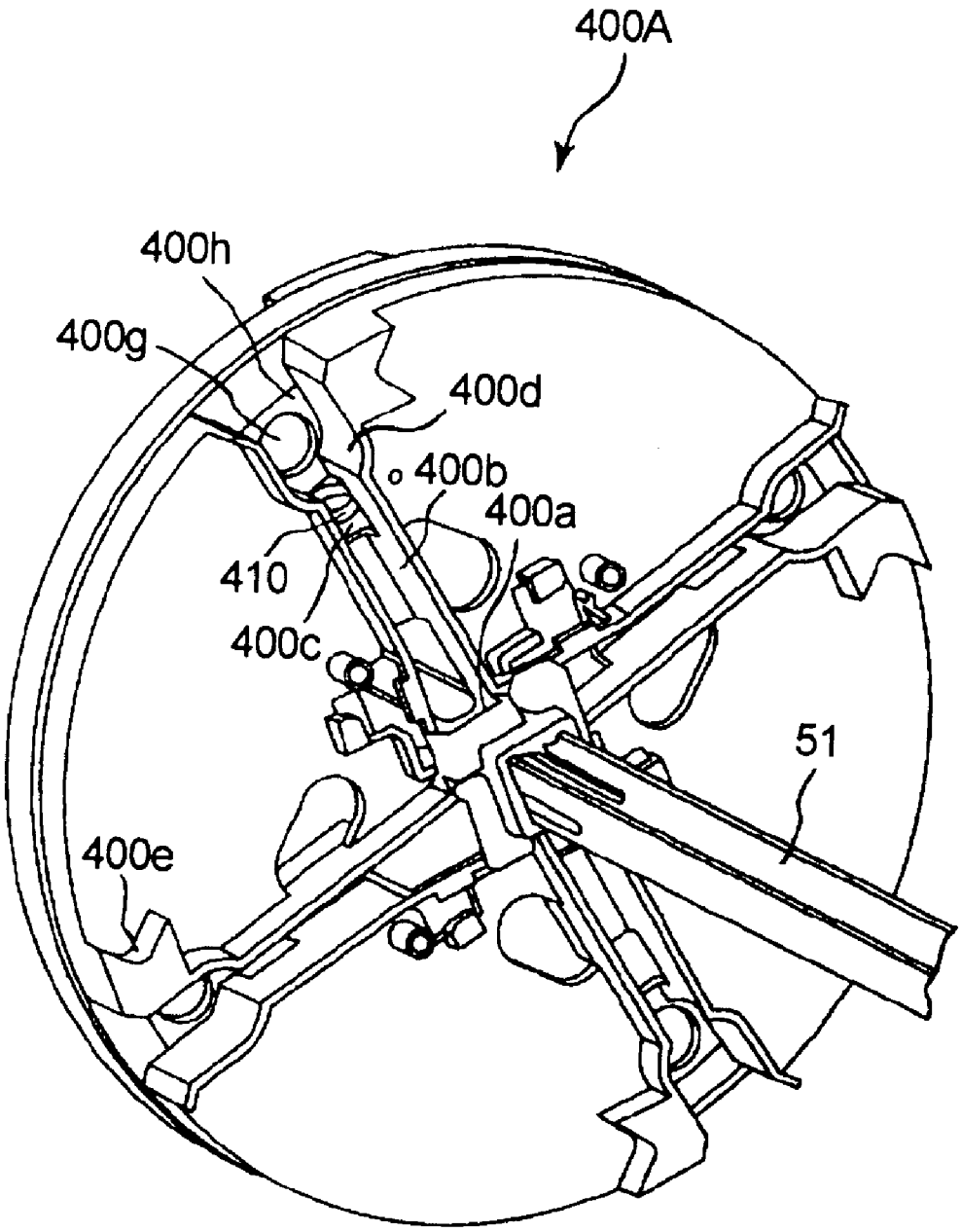
FIG. 12 is a perspective view of the rotary disk, for showing the structure thereof for accommodating development cartridges.
Figure 13:
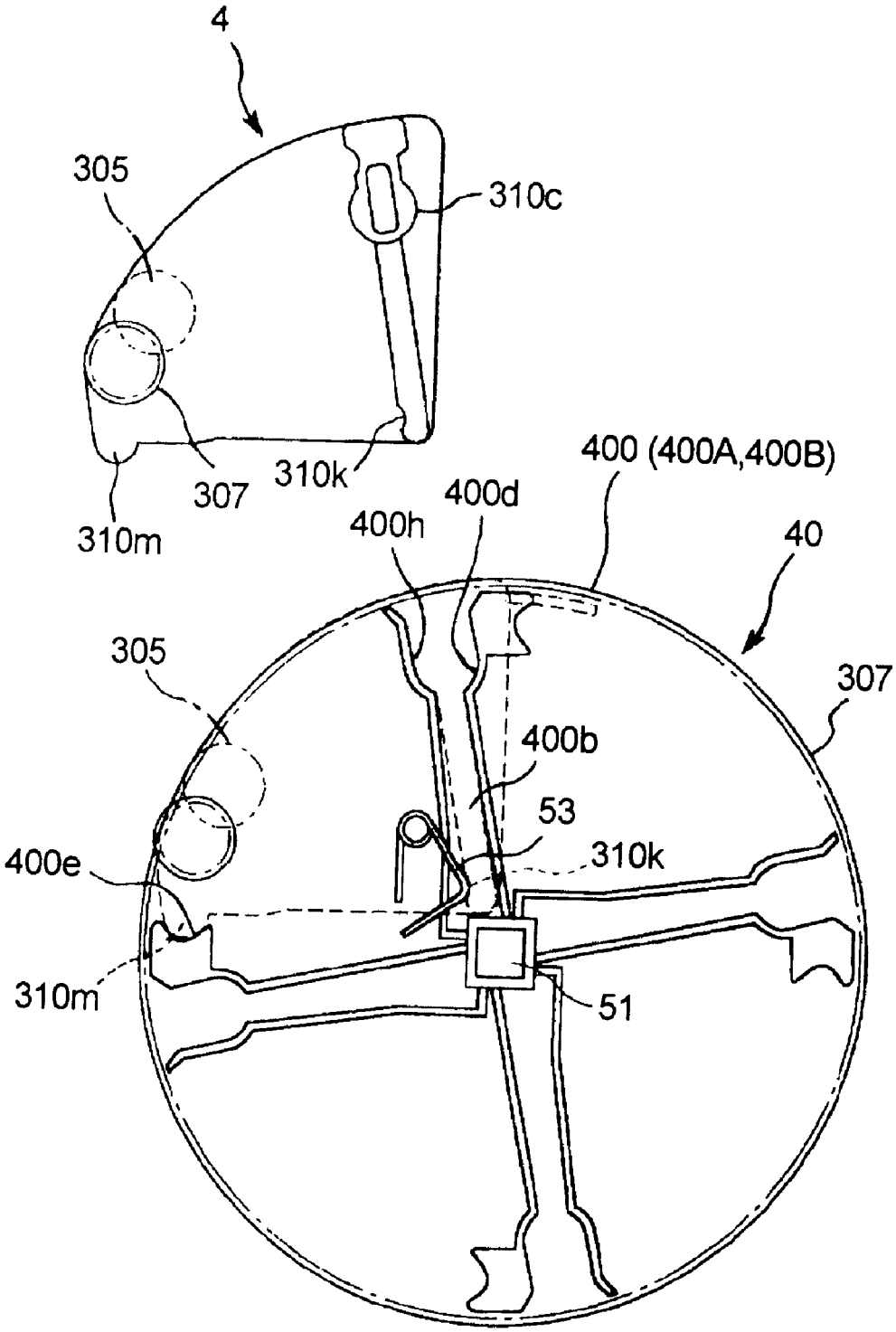
FIG. 13 is a plan view of a development cartridge and one of the rotary discs, showing how the former is engaged with the latter.

Referring to FIGS. 11–13, the rotary device 40 is rotatable about the central axis 51. It comprises the central axis 51, and a pair of rotary disks 400 (400A and 400B) fixed to the lengthwise ends of the central axis 51, one for one.

Rotary disks 400 (400A and 400B) are provided with: four guiding grooves 400*b* for guiding one of the development cartridges 4 when mounting or dismounting the development cartridge 4; four cartridge positioning grooves 400*h*, against the bottom surface of which the development cartridge 4 is butted to be positioned relative to the rotary device 40 in terms of the lengthwise direction of the development cartridge 4; four positioning boss holding receptacles 400*d*, each of which supports a development cartridge 4 by its positioning boss in a manner to allow the development cartridge 4 to pivot, and also function as cartridge positioning portions; and four V-shaped receptacle 400*e* for preventing the development cartridge 4 from rotating.

Figure 4:
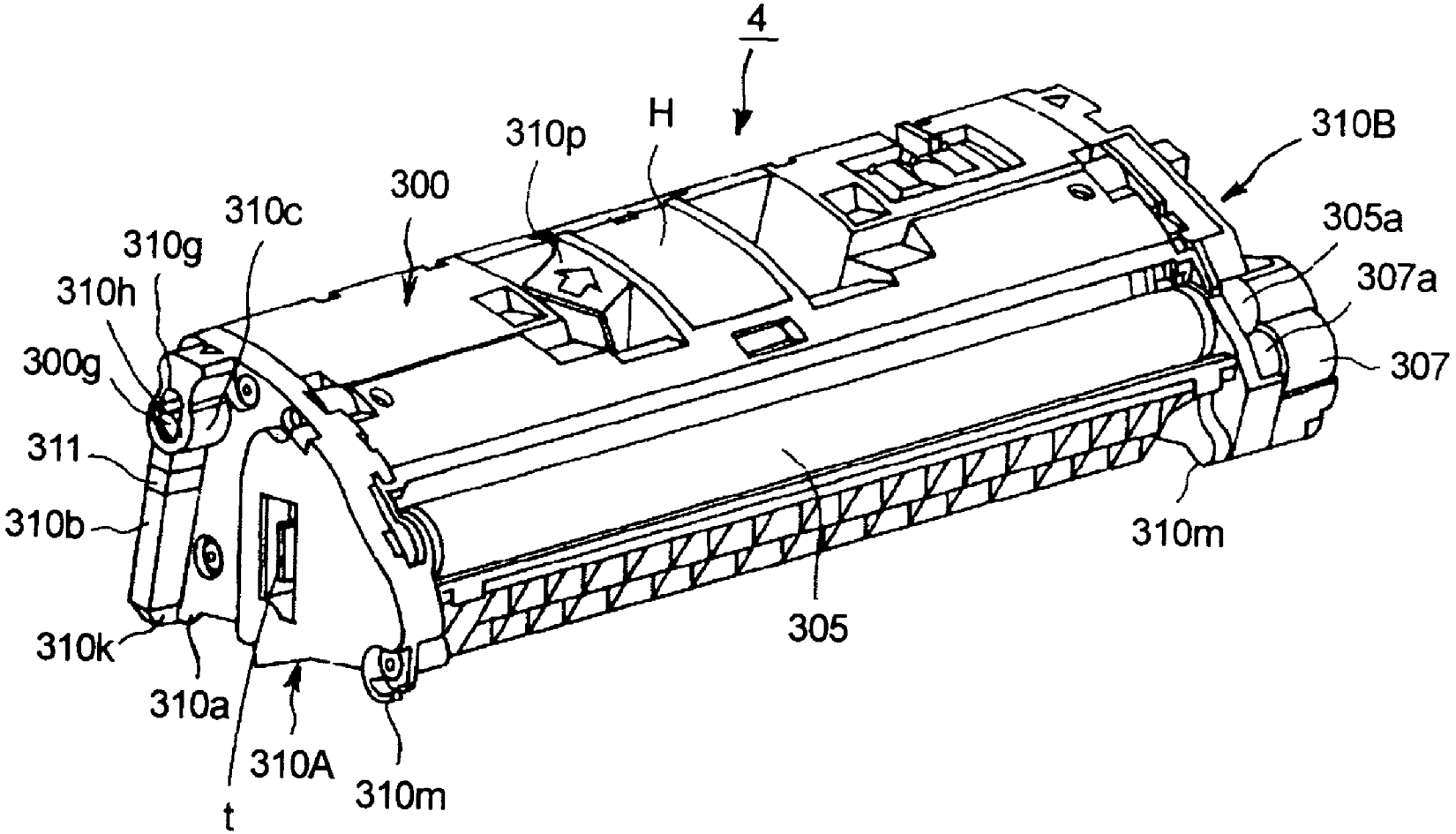
FIG. 4 is a perspective view of the development cartridge in the first embodiment of the present invention.
Figure 5:
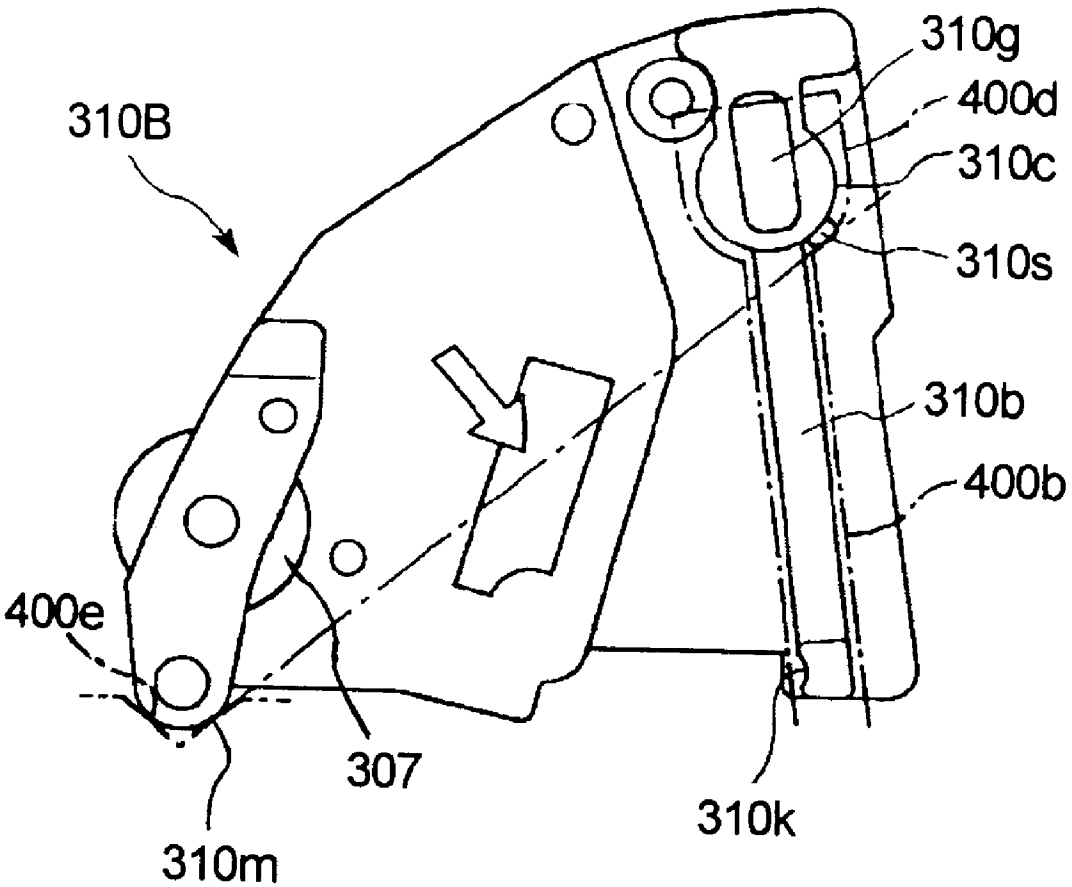
FIG. 5 is a side view of the lengthwise end of the development cartridge, from which the development cartridge is driven.
Figure 6:
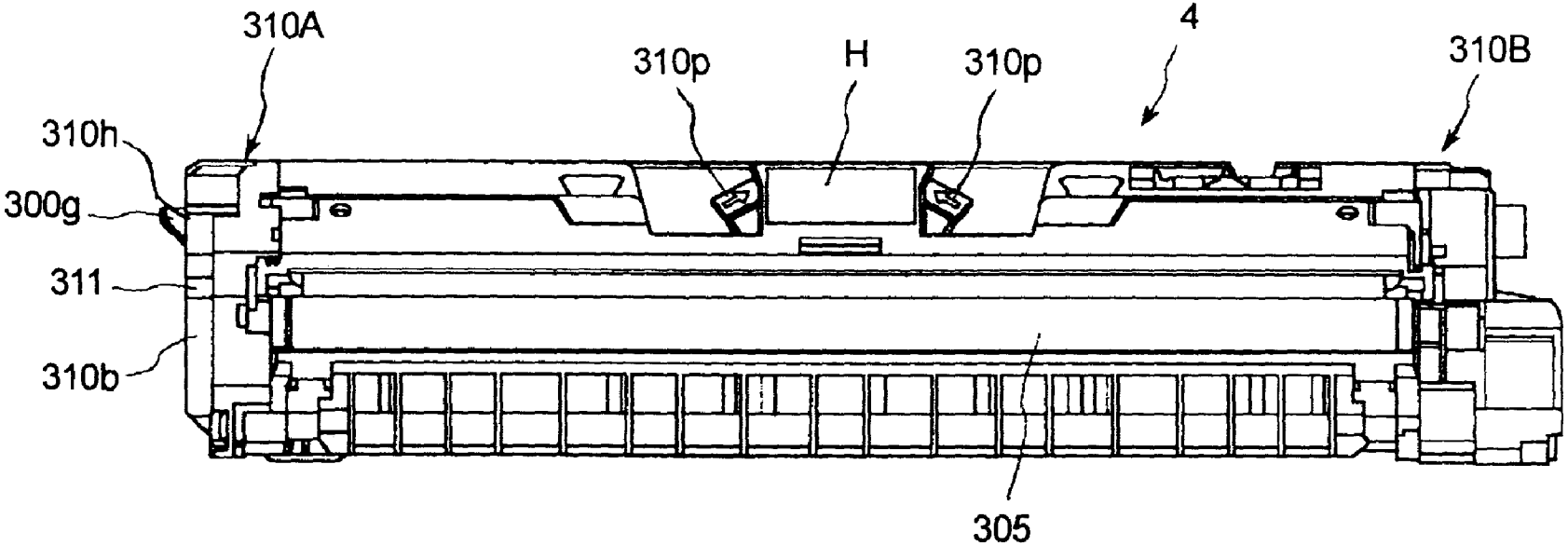
FIG. 6 is a plan view of the development cartridge in FIG. 4, as seen front the photoconductive drum side.

On the other hand, the development cartridge 4 is provided with first and second guides, which project from the left and right ends of the developing member (development roller) 305; in other words, the lengthwise ends of the development cartridge 4, in terms of the lengthwise direction of the development cartridge 4, one for one, as shown in FIGS. 4 and 5. Each of the first and second guides has a positioning boss 310*c*, which is arcuate in cross section, and a flat guide rib 310*b*. The boss 310*c* fits in one of the cartridge positioning groove 400*h*, and corresponding receptacle 400*d*, of the rotary disc 400 (400A and 400B). The guide rib 310*b* fits in one of the guiding grooves 400*b* of the rotary disc 400 (400A and 400B).

Further, the development cartridge 4 is provided with a pair of projections 310*m*, which fit into the corresponding receptacles 400*e* of the rotary discs 400 (400A and 400B) to prevent the development cartridge 4 from rotating and also to precisely position the development cartridge 4 relative to the rotary device. The guide rib 310*b* is provided with a member with an electrical contact 311A for development bias. The electric contact point 311 of the electrical contact 311A, which is to be electrically connected to the electrical contact point 410 (FIG. 17), on the main assembly side, for the development bias, is exposed from one of the lengthwise ends of the development cartridge, that is, from the guide rib 310*b*, more specifically, at least from the top surface of the guide rib 310*b*, which constitutes one of the endmost surfaces of the development cartridge 4 in terms of the lengthwise direction of the cartridge 4.

Referring FIG. 13, the rotary discs 400 (400A and 400B) are provided with a spring 53 for keeping the development cartridge 4 pressured toward the counterclockwise direction of the drawing. The spring 53 is partially in the guiding groove 400*b*, and is in contact with the pressure catching portion 310*k* of the bottom portion of the guiding rib 310*b*. The development cartridge 4 is kept pressured in the direction to rotate about the boss 310*c*, by the resiliency of the spring 53 and the moment generated by the force for rotationally driving the development roller 305. The projections 310*m* of the development cartridge 4 are placed in contact with the receptacles 400*e* of the rotary discs 4000 (400A and 400B), one for one, with no gap.

Figure 7:
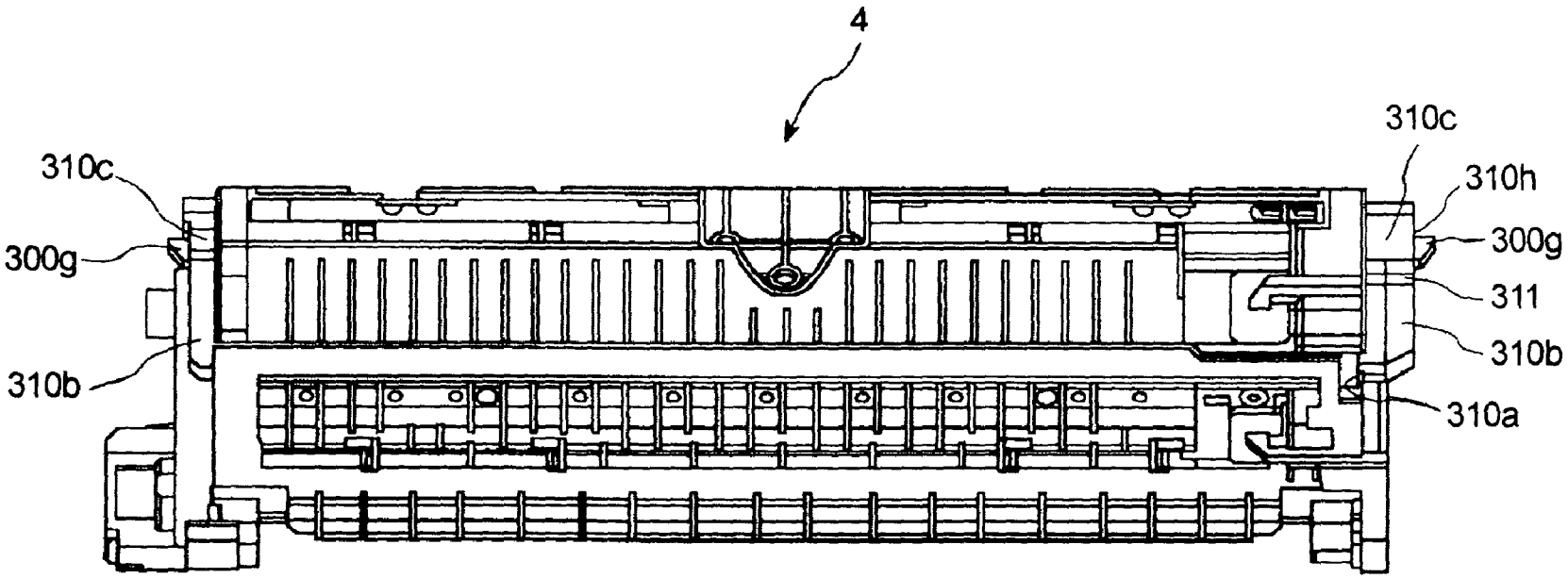
FIG. 7 is a bottom view of the development cartridge in FIG. 4.
Figure 18:
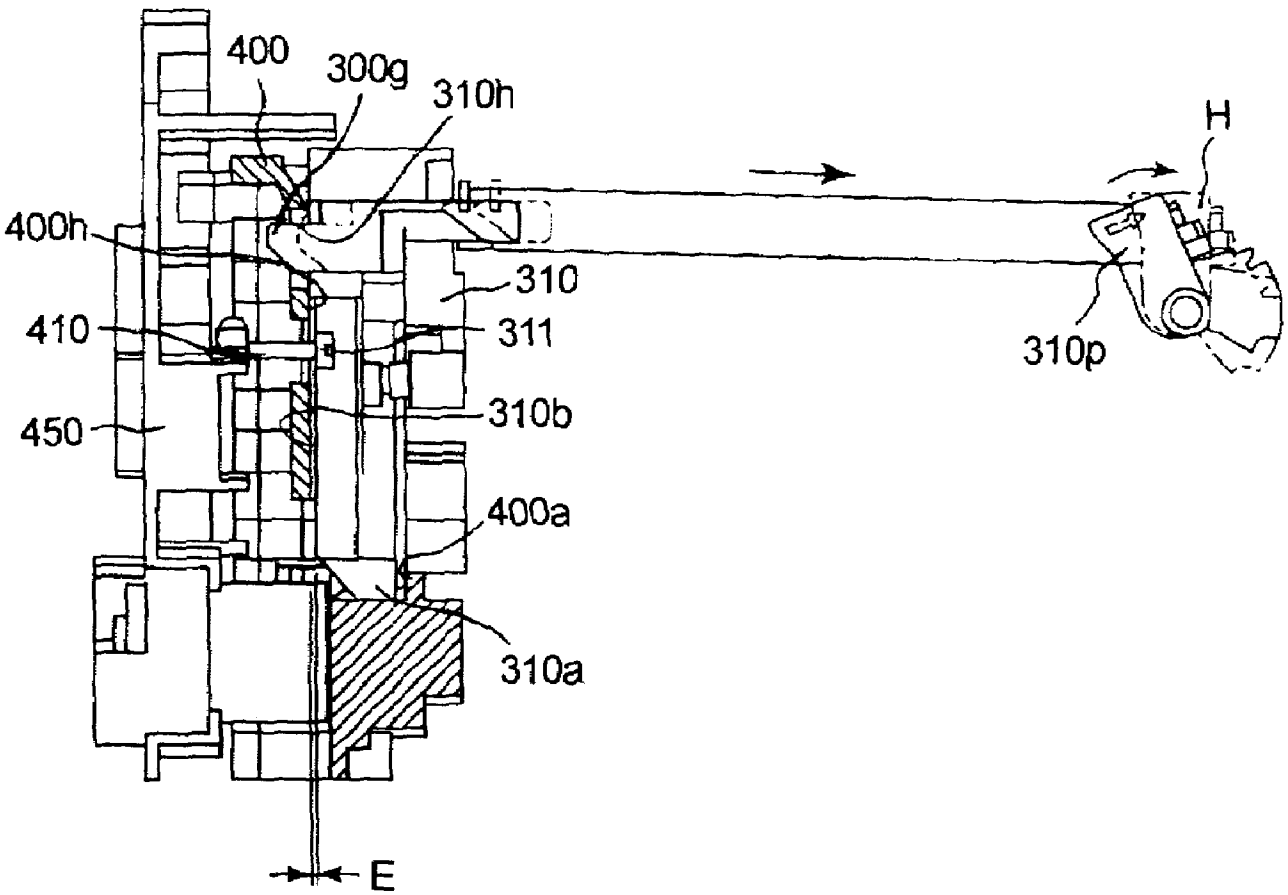
FIG. 18 is a sectional view of the rotary device, on the side from which the rotary disk is not driven, and the corresponding lengthwise end of a development cartridge, showing in detail how the development cartridge is positioned relative to the rotary disk in terms of the lengthwise direction of the development cartridge, and how the electrical contact point on the main assembly side is connected to the electrical contact point on the development cartridge side.

Referring to FIGS. 7, 11, 18, etc., the development cartridge 4 in this embodiment is provided with a development cartridge locking portion 300*g*. This cartridge locking portion 300*g* is allowed to freely move in the lengthwise direction of the development cartridge, in the long hole 310*q* formed in the lengthwise direction of the development cartridge 4 through the positioning boss 310*c*. Normally, it is under such pressure that keeps it projecting outward. As the operational button 310*p* of the handle H of the development cartridge is pushed into the handle H, the cartridge locking portion 300*g* is retracted into the development cartridge.

In other words, as the development cartridge 4 is inserted into the rotary device 40, the cartridge locking portion 300*g* fits into the cartridge locking hole 400*g* in the cartridge positioning groove 400*h* of the rotary disk 400 (400A, 400B). As a result, the development cartridge 4 is reliably retained in the position in which the cartridge locking portion 300*g* fits into the locking hole 400*g*.

With the employment of the above described method for positioning the development cartridge 4, the development cartridge 4 does not become disengaged from the rotary while the rotary device 40 is rotated. In order to remove the development cartridge 4 from the apparatus main assembly, the handle H located at the center of the top surface of the development cartridge 4 is to be grasped while pressing the operational button 310*p* inward of the handle H. With this action, the development cartridge 4 can be pulled out, upward from the rotary device 40 as shown in FIG. 11.

As described above, the development cartridge 4 is held between the two rotary discs 400 (400A and 400B) of the rotary device 40, by the springs 53, cartridge locking portions 300*g*, etc., so that the development cartridge 4 can be easily mounted or dismounted. Thus, the development cartridge 4 can be easily mounted into, or dismounted from, the rotary 40, in other words, the main assembly of an image forming apparatus, through a simple operation carried out by a user.

(Structures for Driving Rotary Device and Development Cartridge)

Next, referring to FIGS. 14–17, the structures for driving the rotary device 40 and development cartridge 4 will be described.

Each of the rotary disks 400 (400A and 400B) is provided with a rotary supporting plate 450, which is on the outward side of the rotary disk 400. The central axis 51 of the rotary device 40 is attached to the rotary disks 400 in such a manner that the central axis 51 penetrates both the rotary disks and rotary supporting plates 450. In other words, the rotary disks 400 and central axis 51 are rotatably supported by the pair of rotary supporting plates 450.

Figure 14:
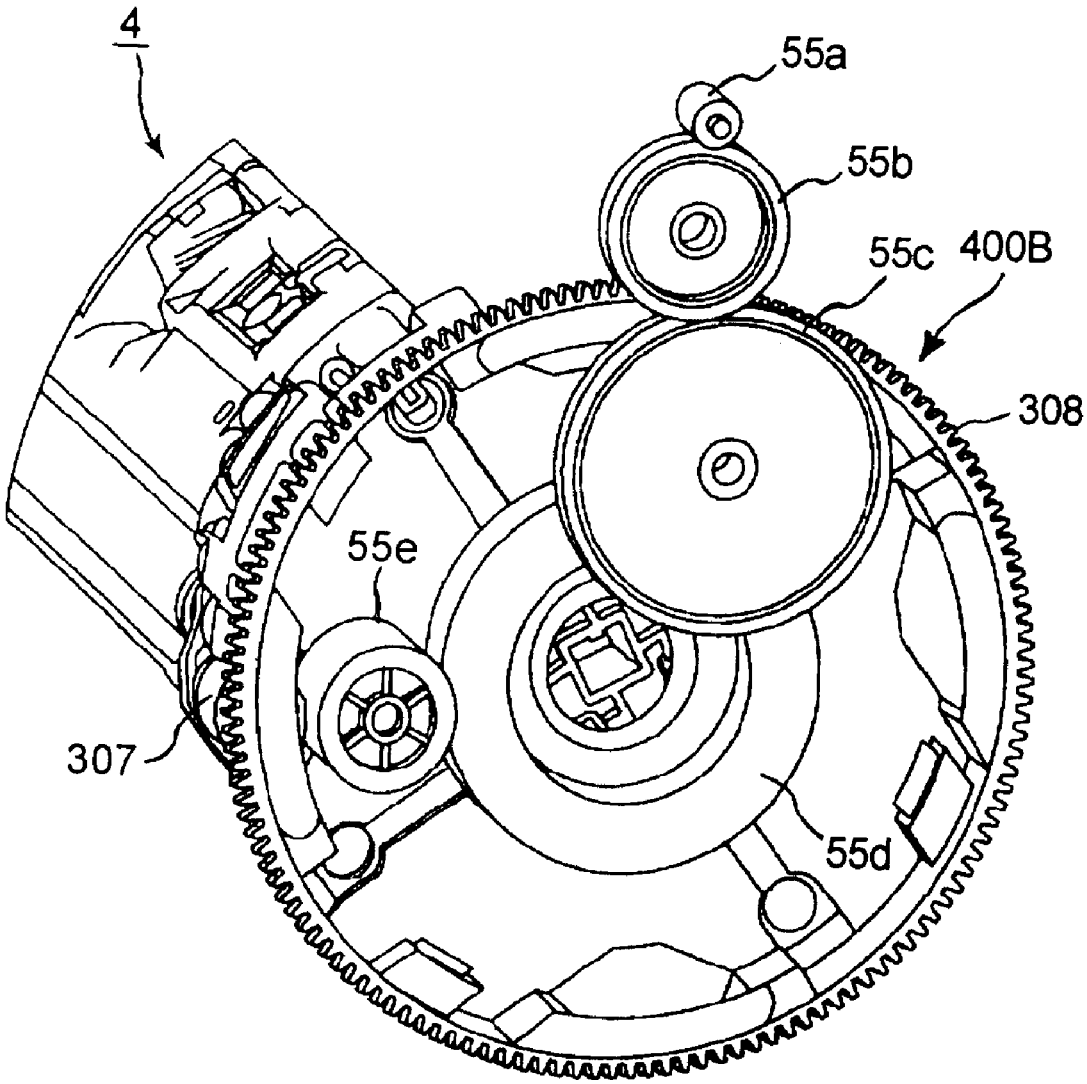
FIG. 14 is a perspective view of the driving force transmission gear train for driving a development cartridge.

Next, referring FIGS. 11 and 14, the peripheral portion of each of the rotary disks 400 (400A and 400B) of the rotary device 40 constitutes a gear 308. The two gear portions 308 are meshed with a pair of follower gears, one for one, located at the lengthwise ends of the rotary device 40, although the follower gears are not shown. The two follower gears are connected by a rotational axis. Thus, as one of the rotary disk 400, for example, the rotary disk 400A, rotates, the other rotary disc, or the rotary disk 400B, is rotated in synchronism with the rotary disk 400A, by the follower gears. The gear portion 308 of one of the rotary disks, which in this embodiment is the gear portion 308 of the rotary disk 400B, is connected to a rotary driving motor (unshown).

With the provision of the above described structure for driving the rotary device, the problem that one of the rotary disks 400 (400A and 400B) is twisted while the rotary disks 400 (400A and 400B) are rotated, or while the development roller is driven, is prevented.

Figure 16:
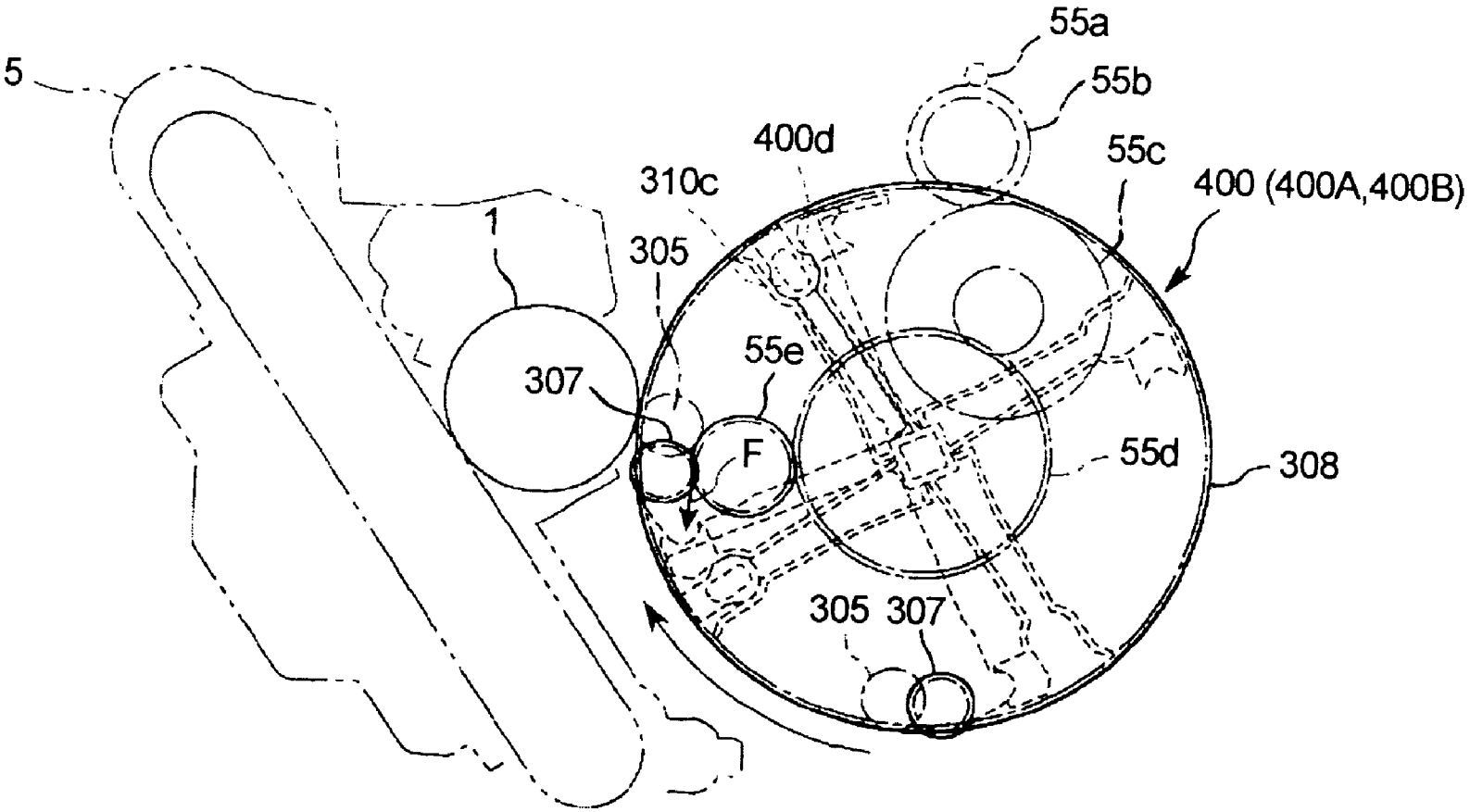
FIG. 16 is a drawing showing the engagement between the gears of the development cartridge in its development position, and the gears of the driving force transmission gear train.

Referring to FIGS. 14 and 16, one of the rotary supporting plates 450, which in this embodiment is the rotary supporting plate 450 for the rotary disk 400B, is provided with a plurality of gears 55 (55*a*, 55*b*, 55*c*, 55*d*, and 55*e*). The input gear 307 of the development cartridge 4 is meshed with the most downstream gear 55*e* of the gear train (driving force transmission gear trains) attached to the rotary supporting plate 450, and rotationally drives the development roller 305, coating roller 304, stirring member 303, etc.

In this embodiment, as the rotary disks 400 rotate, the development cartridge 4 orbitally moves a predetermined angle about the rotational axes of the rotary disks 400, causing its input gear 307 to mesh with the most downstream gear 55*e* of the gear train attached to the rotary supporting plate 450.

Figure 15:
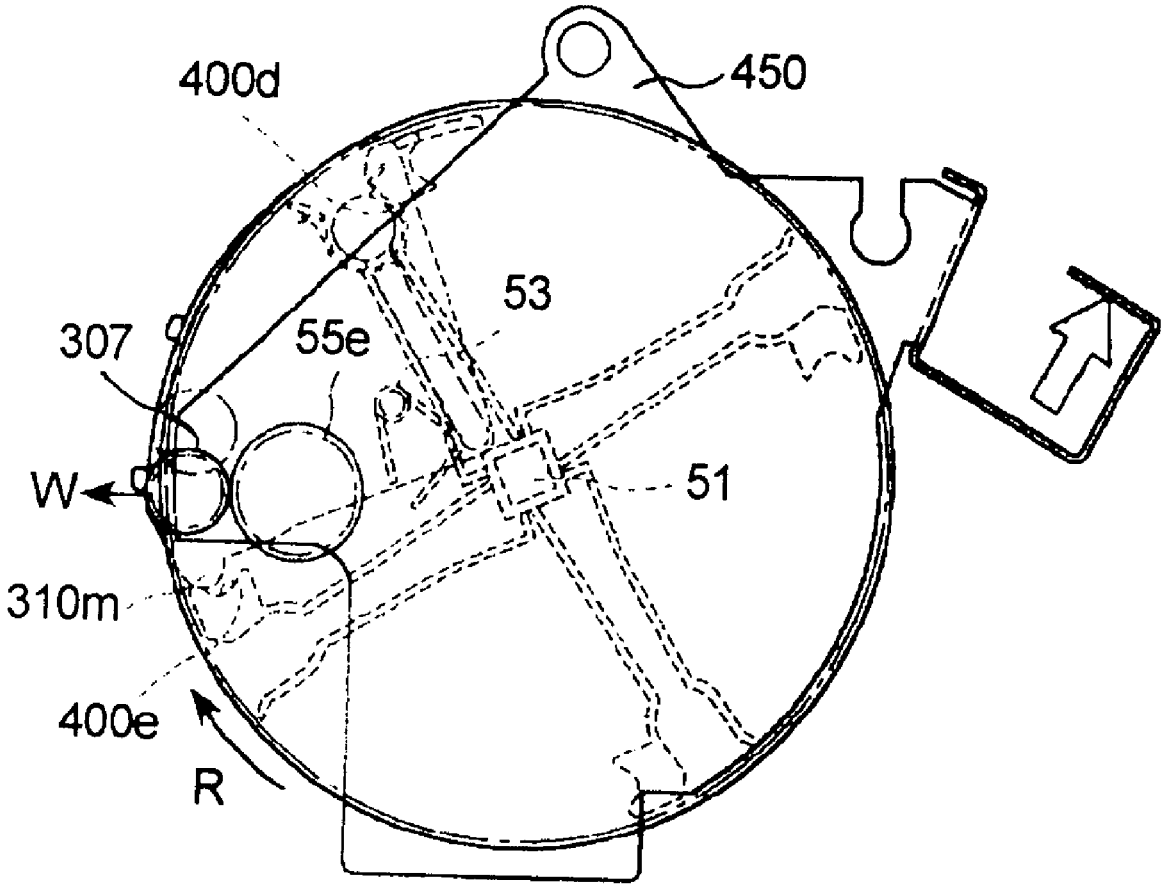
FIG. 15 is a drawing showing how the gear of a development cartridge meshes with the gear of the driving force transmission gear train as the development cartridge is moved into its development position.

Next, referring to FIG. 15, as the development cartridge 4 is orbitally moved in the direction indicated by an arrow mark R to the development position by the rotation of the rotary device 40, the most downstream gear 55*e* of the gear train attached to the rotary supporting plate 450 meshes with the input gear 307 of the development cartridge 4.

As the input gear 307 of the development cartridge 4 is driven by the most downstream gear 55*e* of the rotary supporting plate 450, it is subjected to a force F directed as indicated by an arrow mark in FIG. 16. This force F (moment) acts in the direction to rotate the development cartridge 4 held in the grooves 400*d* of the rotary disks 400, about the positioning bosses 310*c* of the development cartridge 4, in the counterclockwise direction of the drawing. As a result, the projections 310*m* of the development cartridge 4 are kept pressed upon the V-shaped receptacles 400*e* of the rotary disks 400, preventing thereby the development cartridge 4 from moving out of the predetermined development cartridge position in the rotary device 40 while the development cartridge 4 is driven in the development position. This force F is a part of the closed dynamical system within the rotary. Therefore, it has little effect upon the pressure W (FIG. 15) applied to the photoconductive drum 1 by the development cartridge 4.

The above described process for positioning the development cartridge can occur at both rotary disks 400 (400A and 400B) at the same time.

In this embodiment, however, the cartridge positioning process which occurs occur on the rotary disk 400B side is made different from that on the rotary disk 400A side.

More specifically, referring to FIG. 5, the size (diameter) of the positioning boss 310*c* on the rotary disk 400B side of the development cartridge 4 is made smaller than that of the positioning receptacle 400*d* of the rotary disc 400B in order to provide a predetermined amount of gap between the two. However, the positioning boss 310*c* is provided with a rib 310*s*, which projects from a part of the peripheral surface of the positioning boss 310*c* so that it contacts the inward surface of the positioning receptacle 400*d*.

With the provision of the above described structural arrangement, the positioning boss 310*c* of the development cartridge, on the rotary disk 400A side, precisely fits in the positioning boss holding receptacle 400*d* of the rotary disk 400A, and the projection 310*m* of the development cartridge contacts the V-shaped receptacle 400*e* of the rotary disk 400A. As a result, the development cartridge 4 is highly precisely positioned.

On the other hand, on the rotary disk 400B side, the positioning boss 310*c* of the development cartridge loosely fits in the positioning boss holding receptacle 400*d* of the rotary disk 400B. However, as the development cartridge 4 begins to be driven by being moved to the development position, the development cartridge 4 is subjected to such force that presses the development cartridge 4 in the direction of the arrow mark. As a result, the projection 310*m* of the development cartridge fits into the V-shaped receptacle 400*e* of the rotary disc 400A. In addition, the rib 310*s* projecting from a part of the peripheral surface of the positioning boss 310*c* comes into contact with the inward surface of the positioning boss holding receptacle 400*d*. Therefore, the development cartridge 4 is accurately placed in the predetermined position.

Also in this embodiment, the development cartridge 4 is precisely positioned relative to the main assembly, more specifically, the rotary device 40, of an image forming apparatus, by being moved to the development position.

(Method for Mounting Development Cartridge into Image Forming Apparatus)

Next, the structures of the guide ribs 310*b* of the development cartridge 4, and the structure of the electrical contact of the development cartridge 4 for development bias, will be described.

Figure 8:
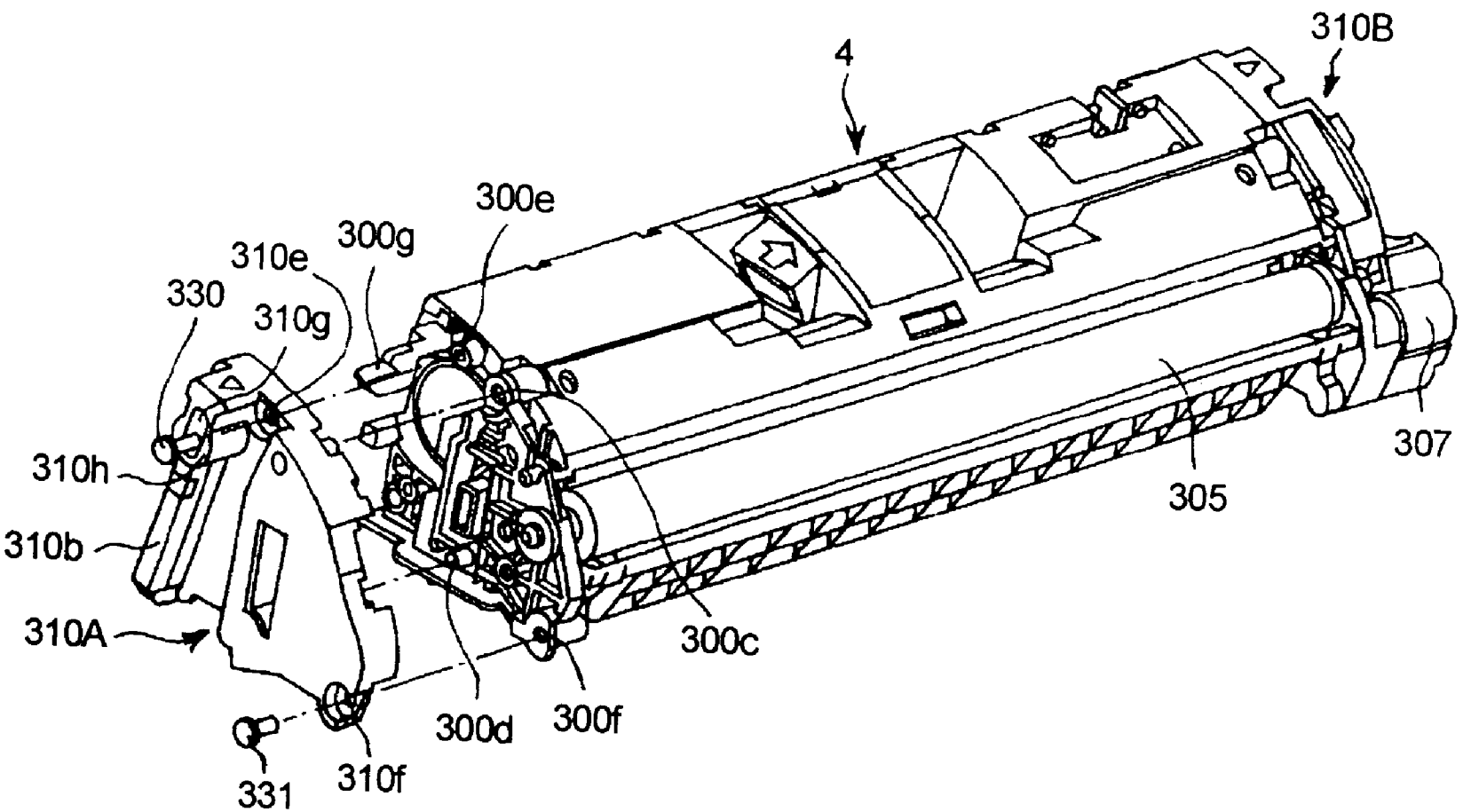
FIG. 8 is a perspective view of the partially exploded view of the development cartridge in FIG. 4, for showing how one of the side covers is attached.

Referring to FIGS. 4–10, in this embodiment, the lengthwise ends of the main structure of the development cartridge 4 are covered with side covers 310 (310A and 310B), one for one, which are separable from the main assembly of the development cartridge 4. FIG. 8 shows the development cartridge 4, the side cover 310A, that is, the left side cover in the drawing, which has been separated from the main assembly of the development cartridge.

Figure 9:
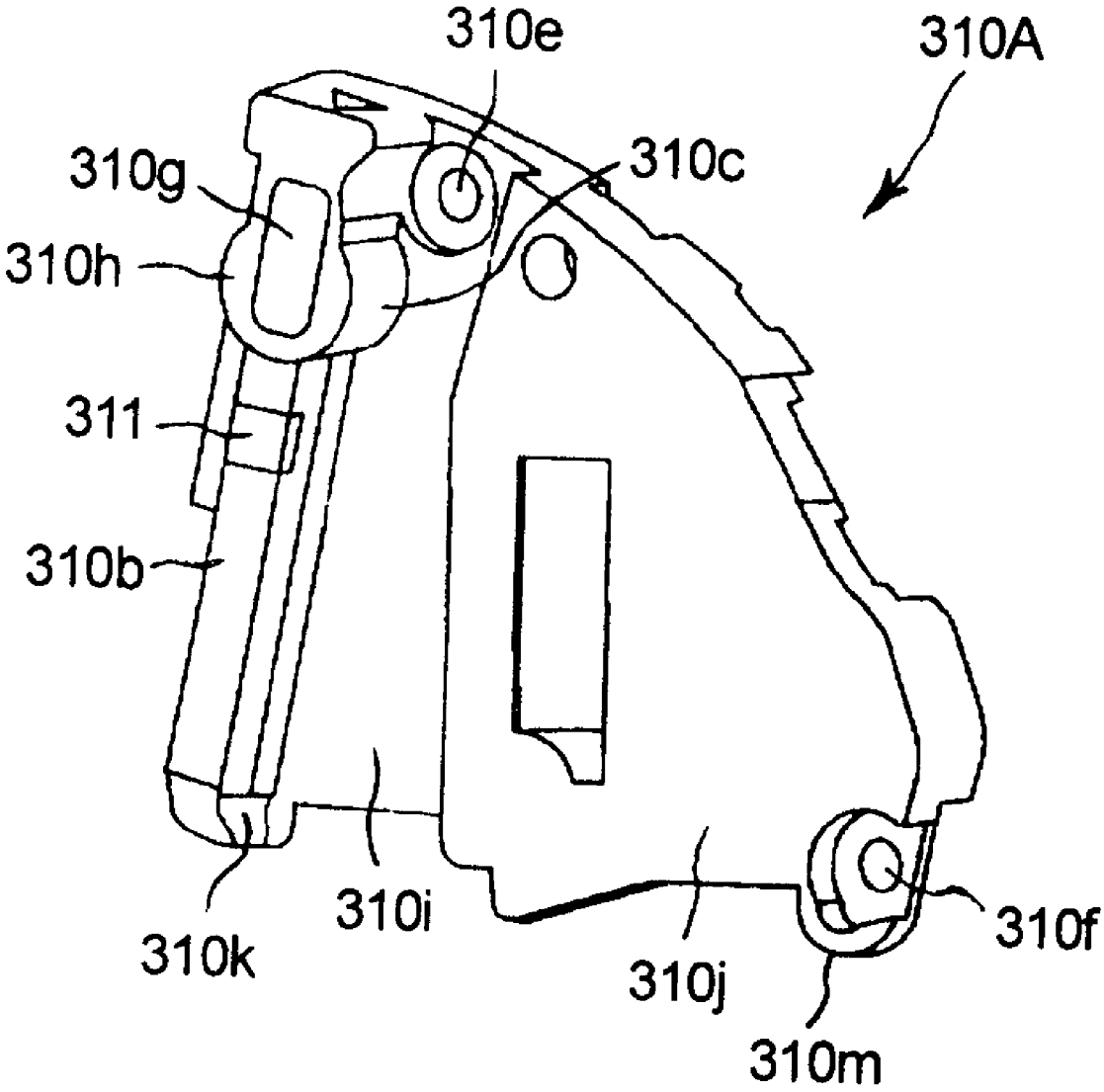
FIG. 9 is a perspective view of the side covers shown in FIG. 4, for showing the outward side of the side cover.
Figure 10:
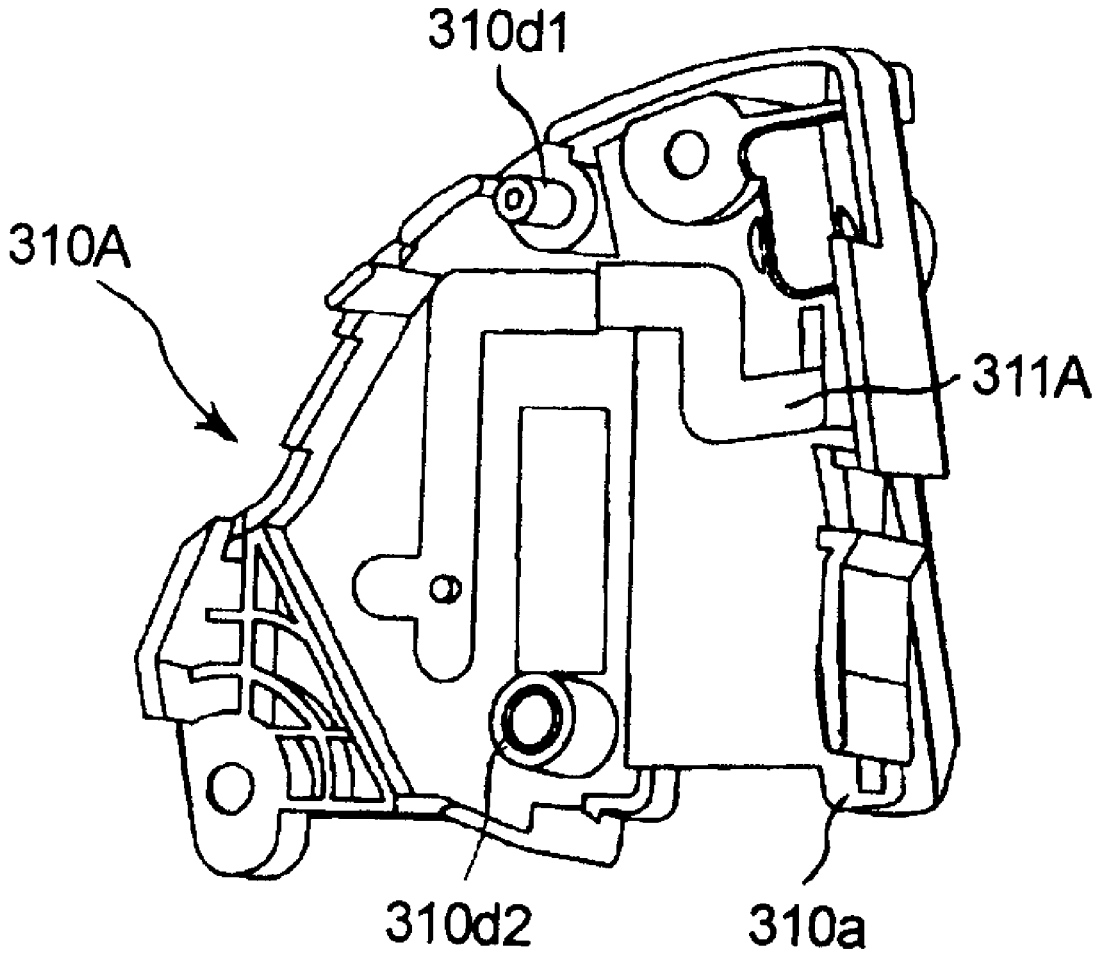
FIG. 10 is a perspective view of the side cover in FIG. 4, for showing the inward side thereof.

Referring to FIGS. 8–10, the side cover 310A is attached to the development cartridge main assembly in the following manner: First, the positioning hole 300*c* of the development cartridge main assembly (which hereinafter may be referred to "cartridge frame") is to be aligned with the positioning boss 310*d*1 of the side cover 310. Then, screws 330 and 331 are to be put through the holes 310*e* and 310*f* of the side cover 310A, and then, are to be screwed into the holes 300*e* and 300*f* of the development cartridge main assembly, respectively. The side cover 310B is attached to the development cartridge main assembly also with screws in the same manner as the side cover 310A.

The development cartridge 4 is provided with the positioning bosses 310*c* for positioning the development cartridge 4, and guide ribs 310*b* for guiding the development cartridge 4. More specifically, each of the side covers 310 (310A and 310B) located at the lengthwise ends of the development cartridge main assembly, one for one, is provided with the positioning boss 310*c* and guide rib 310*b*. Thus, as the positioning bosses 310*c* and guide ribs 310*b* of the development cartridge 4 are inserted into the corresponding cartridge positioning grooves 400*h*, positioning boss holding receptacles 400*d*, guiding grooves 400*b*, etc., of the rotary disks 400 (400A and 400B), the development cartridge 4 is disposed in the predetermined position relative to the rotary disks 400 (400A and 400B), in other words, it is precisely disposed in the image forming apparatus main assembly.

The side cover 310A of the development cartridge 4 is provided with the electrical contact 311A for development bias, the contact point 311 of which is exposed from the top surface of the guide rib 310*b*. As the development cartridge 4 is fixed in position by being moved into the development position, the electrical contact point 311 for the development bias, which will be described later in detail, becomes electrically connected to the electrical contact point 410 (FIG. 19) for the development bias, on the apparatus main assembly side.

Referring to FIG. 10, in this embodiment, the development bias electrical contact 311A having the development bias contact point 311 is wired so that as the side cover 310A is attached to the development cartridge main assembly, the development bias electrical contact 311A becomes connected to the developing member (development roller) 305 and developer coating member (toner supplying roller) 304 of the development cartridge 4. With this structural arrangement, it is possible to apply both the development bias and coating member bias to the development roller 305 and toner supplying roller 304, respectively.

The development bias contact point 311 is disposed on the guide rib 310*b*. Therefore, as the development cartridge is mounted into the rotary device 40, the contact point 311 is moved in the direction parallel to the direction in which the development cartridge is mounted. Further, the guide rib 310*b* is such a portion of the development cartridge 4 that guides the development cartridge 4 by being fitted in the cartridge guiding groove 400*b* of the rotary disk 400, and the contact point 311 is exposed from the top surface of the guide rib 310*b*. Therefore, the contact point 311 is guided in the same manner as the guide rib 310*b*, assuring that the contact point 311 is precisely placed in a position in which it allows the development bias to be applied from the image forming apparatus main assembly.

Next, referring to FIGS. 4 and 18, the development cartridge 4 has a first projection 310*h* and a second projection 310*a*. The first projection 310*h* is butted against the development bias electrical contact side of the image forming apparatus main assembly, in order to accurately position the development cartridge main assembly in terms of its lengthwise direction, and the second projection 310*a* is for regulating the movement of the development cartridge 4 in the direction opposite to the direction in which the development cartridge 4 is butted against the development bias electrical contact side of the image forming apparatus main assembly. These structural arrangements and the operations thereof will be described later.

Next, referring to FIGS. 11 and 12, the rotary device 40 and rotary disks 400 (400A and 400B) will be further described.

FIG. 11 shows how one of the development cartridges 4 is inserted into the rotary device 40, and FIG. 12 shows the details of the rotary disk 400A, that is, the rotary disk 400 on the side from which the rotary device 40 is not driven.

Referring to FIG. 12, the rotary disk 400A, on the side from which the rotary device 40 is not driven, has: a cartridge positioning groove 400*h* for assuring that the development bias electrical contact of the development cartridge 4 is placed in contact with the development bias electrical contact on the apparatus main assembly side; a positioning boss holding receptacle 400*d* for supporting the positioning boss 310*c* of the development cartridge 4; a groove 400*a* for regulating the movement of the development cartridge 4 in the direction opposite to the direction in which the development cartridge is butted against the development bias electrical contact side of the rotary device 40; a guiding groove 400*b*, a hole 400*c* for allowing the development bias electrical contact 410 on the apparatus main assembly side to make contact with the development bias electrical contact on the development cartridge side; and a hole 400*g* into which a development cartridge position locking portion of the development cartridge 4 fits.

Referring to FIG. 11, the development cartridge 4 is to be inserted into the rotary device 40 with the guide portions 310*b* on the lengthwise ends of the development cartridge 4 aligned with the guiding grooves 400*b*, one for one. After the insertion, the rotary device 40 is rotated so that the development cartridge 4 is moved to the location at which it comes into contact with the electrical contact point 410 attached to the supporting plate 450 of the rotary 40 shown in FIG. 17.

FIG. 15 shows the development cartridge 4 which has been locked into the predetermined position, that is, the development position.

Figure 19:
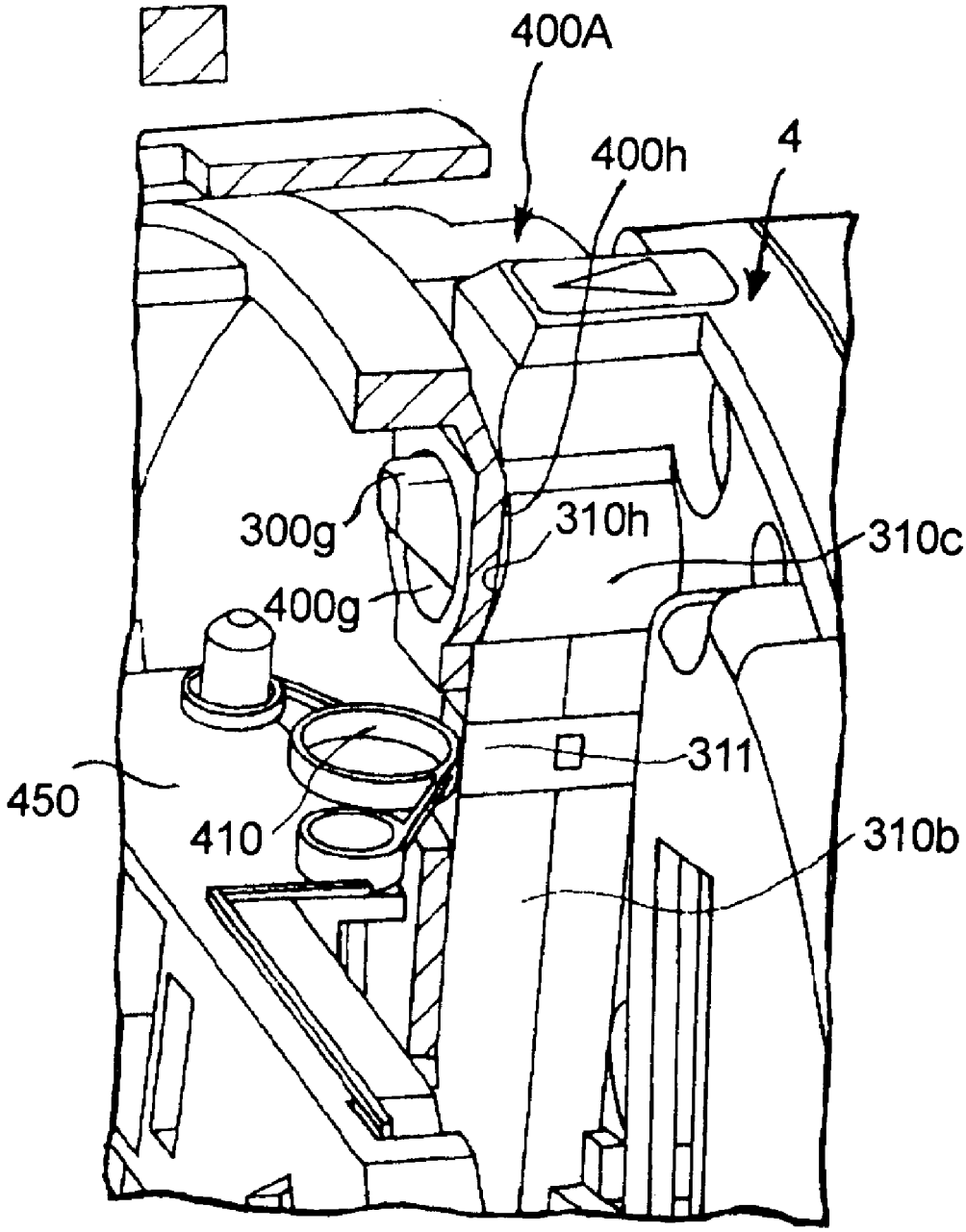
FIG. 19 is also a perspective view of a part of the rotary device, on the side from which the rotary device is not driven, and the corresponding lengthwise end of a development cartridge, showing in detail how the development cartridge is positioned relative to the rotary in terms of the lengthwise direction of the development cartridge, and how the electrical contact point on the main assembly side is connected to the electrical contact point on the development cartridge side.

While being kept in the above-described state, the development cartridge 4 is driven by the driving force from the image forming apparatus main assembly. As a result, the first projection 310*h* of the development cartridge 4 comes into contact with the cartridge positioning groove 400*h* of the rotary 40, securing a predetermined distance between the development bias electrical contact point 410 of the apparatus main assembly and the development cartridge 4, as shown in FIGS. 18 and 19.

In other words, as the development cartridge 4 is moved into the development position, the driving gear 55*e* on the apparatus main assembly side engages with the driving gear 307 of the development cartridge 4, as shown in FIG. 15. As a result, the driving force is transmitted from the driving force input gear 307 to the development roller driving gear 305*a* through an idler gear 307*a* integral with the driving force input gear 307, as shown in FIG. 4.

In this embodiment, the driving force input gear 307, idler gear 307*a*, and development roller driving gear 305*a* are helical gears, and the driving force input gear 307 is driven. With the provision of the above described structural arrangement, as the driving force is transmitted to the driving force input gear 307, the development roller 305 and development cartridge 4 are pressed leftward in terms of the lengthwise direction of the development cartridge 4 in FIGS. 4 and 11. As a result, the first projection 310*h* of the development cartridge 4 comes into contact with the cartridge positioning groove 400*h* of the rotary device 40, as shown in FIG. 19.

As for the movement off the development cartridge 4 in the opposite direction (rightward in FIGS. 4 and 11) in terms of its lengthwise direction, the end surface of the second projection 310*a* attached to the development cartridge 4 makes contact with the bottom surface of the groove 400*a* of the rotary disk 400 of the image forming apparatus main assembly, regulating thereby the movement of the development cartridge in the aforementioned opposite direction in terms of its lengthwise direction.

In other words, the member 310*a* is provided for regulating the movement of the development cartridge 4 in the opposite direction even if the projection 310*h* of the development cartridge 4 fails to satisfactorily come into contact with the contact portion of the cartridge positioning groove 400*h* of the rotary device 40 due to irregularities in the driving of the development cartridge 4. Therefore, the fluctuation of the distance between the development bias electrical contact point 410 of the image forming apparatus main assembly and the development bias electrical contact point 311 of the development cartridge 4 can be minimized.

Figure 17:
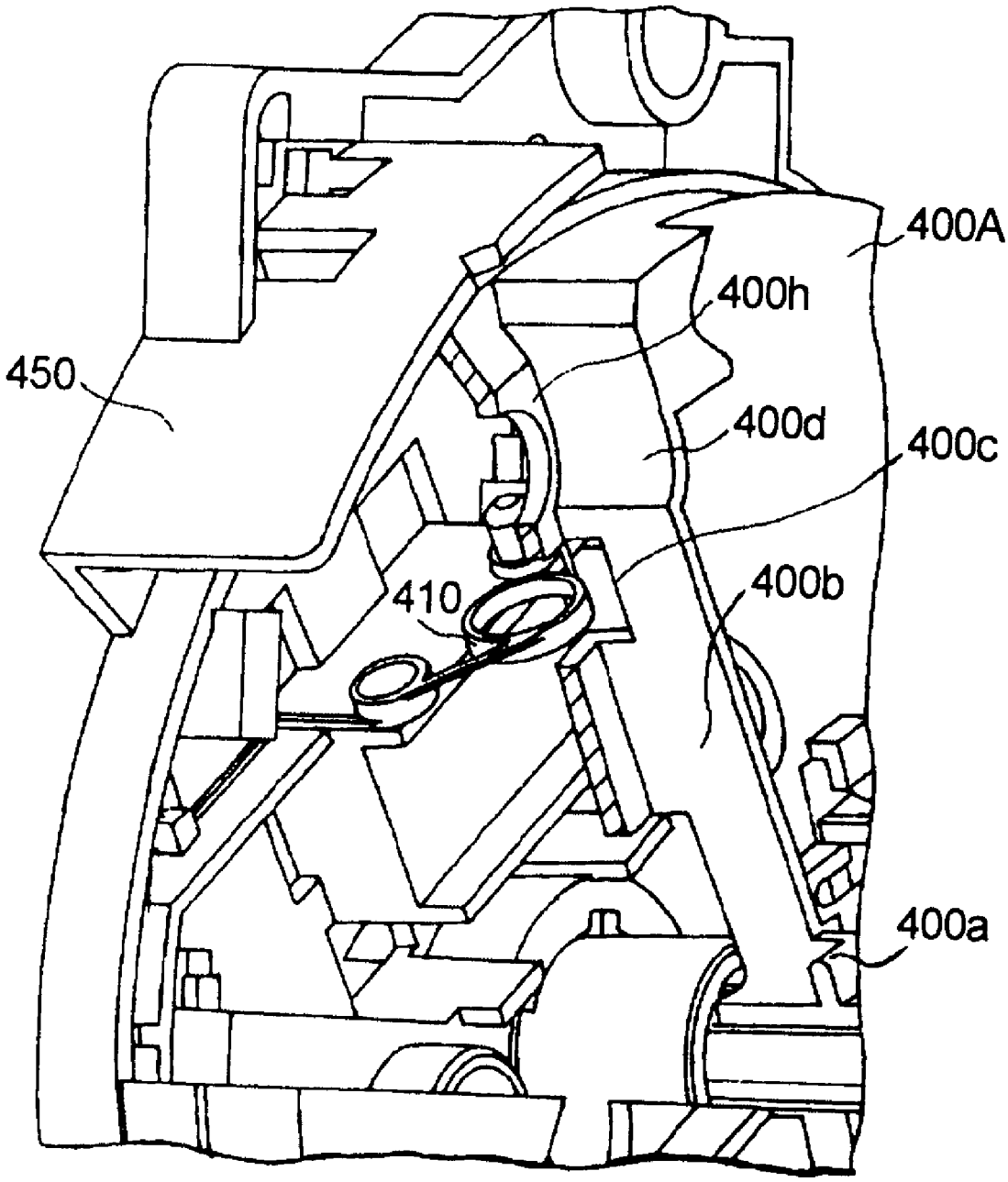
FIG. 17 is a perspective view of a part of the rotary device, on the side from which the rotary disk is not driven, showing in detail the connection between the electrical contact point on the main assembly side of the image forming apparatus and the electrical contact point on the development cartridge side, in the first embodiment of the present invention.

In this embodiment, the development bias electrical contact point 410 is in the form of a coil spring, and is fixed to the supporting plate 450 of the rotary 40, as shown in detail in FIGS. 17 arid 19. As the development cartridge 4 is moved to the predetermined position, the development bias electrical contact point 311 comes into contact with the development bias electrical contact point 410.

The development bias electrical contact point 311 is attached to the guide rib 310*b* on the side from which the development cartridge 4 is not driven, and the first projection 310*h* for positioning the development cartridge 4, the boss 310*c*, and the guide rib 310*b* are integral. Therefore, the error in the distance between the first projection 310*h* for positioning the development cartridge 4 in terms of its lengthwise direction, and the development bias electrical contact point 311, can be reduced to the error in the position of a single component resulting from the tolerance for the single component.

Further, as for the positional relationship between the development bias electrical contact point 410 of the image forming apparatus main assembly and the development bias electrical contact point 311 of the development cartridge 4, there are only the rotary supporting plate 450, development bias electrical contact point 410, rotary device 40, and the contact point 311 of the development cartridge 4, in that order from the outward side of the rotary 40.

In other words, the number of the components between the development bias electrical contact point 410 of the image forming apparatus main assembly and the development bias electrical contact point 311 of the development cartridge 4 is substantially smaller compared to that in accordance with the prior art; the overall error resulting from the sum of the tolerances of the components between the two development bias electrical contact points 410 and 311 can be minimized. In addition, the above described structural arrangement makes it easier to keep the predetermined distance between the two contact points. Therefore, the development bias can be reliably applied.

Further, the positioning of the development cartridge 4 in terms of its lengthwise direction, and the application of the development bias, are done on the rotary disk 400A side, that is, the rotary disk on the side from which the development cartridge 4 is not driven, in other words, on the side opposite to the driving force input portion having the driving force input gear 307. Therefore, the distance between the development bias electrical contact point 410 of the image forming apparatus main assembly and the development bias electrical contact point 311 of the development cartridge 4 is less likely to be affected by the minute displacement of the development cartridge 4 in its widthwise direction caused by the driving force; it is easier to keep the development bias electrical contact point 410 of the image forming apparatus main assembly and the development bias electrical contact point 311 of the development cartridge 4 at the predetermined locations. Therefore, it is possible to reliably apply the development bias.

Referring to FIG. 9, the electrical contact point 311 of the development cartridge 4 mounted in an electrophotographic image forming apparatus equipped with the rotary type developing apparatus 4A is disposed on the guide rib 310*b* which is raised from the surfaces 310*i* and 310*j*. Further, such a structural arrangement is made that the resinous portions of the development cartridge 4 neither intersect with the orbital path of the development bias electrical contact point 311 of the development cartridge 4 while the rotary device 40 is rotated, nor are they as high, from the surfaces 310*i* and 310*j*, as the development bias electrical contact point 311. With the provision of this structural arrangement, the bias voltage can be applied without damaging the resinous portion of the development cartridge 4.

Further, referring to FIG. 18, the top surface of the guide rib 310*b* is recessed inward of the development cartridge 4 by a distance E from the end surface of the projection 310*h* for regulating the position of the development cartridge 4 in its lengthwise direction.

Also with the provision of the above-described structural arrangement, it is unnecessary to provide the surfaces 310*i* and 310*j* of the development cartridge 4 with a portion, in addition to the guide rib 310*b*, higher than the surfaces 310*i* and 310*j*, in order to attach the development bias electrical contact point 311. Therefore, it is possible to save space. Further, the surfaces 310*i* and 310*j* have nothing which hangs up when inserting the development cartridge. Therefore, the development cartridge can be smoothly inserted, improving the development cartridge in terms of the efficiency with which the development cartridge is mounted or dismounted.

As described above, in this embodiment, the development cartridge 4 is provided with the second projection for regulating the movement of the development cartridge 4 in the direction opposite to the location of the first projection 310*h* for positioning the development cartridge 4 in its lengthwise direction, whereas the rotary device 40 of the image forming apparatus main assembly is provided with the regulation groove 400*a* for regulating the movement of the development cartridge 4 in the direction opposite to the cartridge positioning groove 400*h*. With the provision of this structural arrangement, it is easier to keep constant the distance between the development bias electrical contact point 410 and development bias electrical contact point 311, making it possible to reliably apply the development bias voltage.

Also in this embodiment, the position of the development cartridge 4 in its lengthwise direction, and the application of the development bias, are accomplished from the side from which the development cartridge 4 is not driven, that is, from the side apart from the portion of the development cartridge 4 through which the driving force is inputted into the development cartridge 4. Therefore, the positioning of the development cartridge 4 and application of the development bias are less likely to be affected by the displacement of the development cartridge 4 in the widthwise direction of the development cartridge 4 by the driving force, making it possible to reliably apply the development bias.

Also in this embodiment, the development bias electrical contact point 311 is attached to the guide rib 310*b* of the development cartridge 4. Therefore, the resinous portion of the development cartridge 4 in the adjacencies of the electrical contact point 311 is not damaged when the rotary device 40 is rotated. Therefore, it is unnecessary to set up the development bias electrical contact point 311 one step higher than the surfaces 310*i* and 310*j* of the development cartridge 4; it is possible to reduce the development cartridge 4 in size. Also with the above described structural arrangement, the development cartridge 4 has no portion which hangs up when mounting or dismounting the development cartridge 4. Therefore, it is possible to smoothly mount or dismount the development cartridge 4, improving the efficiency with which the development cartridge 4 is operated by a user.

Embodiment 2

FIGS. 20–23 show the second embodiment of a development cartridge 4 in accordance with the present invention.

The general structure of the development cartridge 4 in this embodiment is the same as that in the first embodiment, except that in this embodiment, a pair of development bias contacts 311A and 312A are attached to the guide rib 310*b* on one of the lengthwise end surfaces of the development cartridge 4. Thus, the components, members, etc., in this embodiment, which are similar in structure and function to those in the first embodiment described above, are given the same reference numbers as those given in the first embodiment, and their detailed descriptions will not be given.

In other words, also in this embodiment, the lengthwise end surface, on the side from which the development cartridge 4 is not driven, of the development cartridge 4, that is, the outward surface of the side cover 310A, is provided with: the first projection 310*h* for positioning the development cartridge 4 in its lengthwise direction; cartridge positioning boss 310*c*; second projection 310*a* for regulating the movement of the development cartridge 4 in the direction opposite to the direction in which the development cartridge 4 is pressed in terms of its lengthwise direction; and guide rib 310*b* for guiding the development cartridge 4 to the predetermined position when inserting the development cartridge 4, as in the first embodiment. In this embodiment, however, the guide rib 310*b* is provided with the pair of development bias electrical contacts 311A and 312A, which are disposed so that the development bias electrical contact points 311 and 312 are exposed at least from the top surface of the guide rib 310*b*.

These development bias electrical contact points 311 and 312 are electrically connected to the development bias electrical contact points 410 and 411 (FIG. 23) of the image forming apparatus main assembly, as the development cartridge 4 is moved into the development position.

Figure 22:
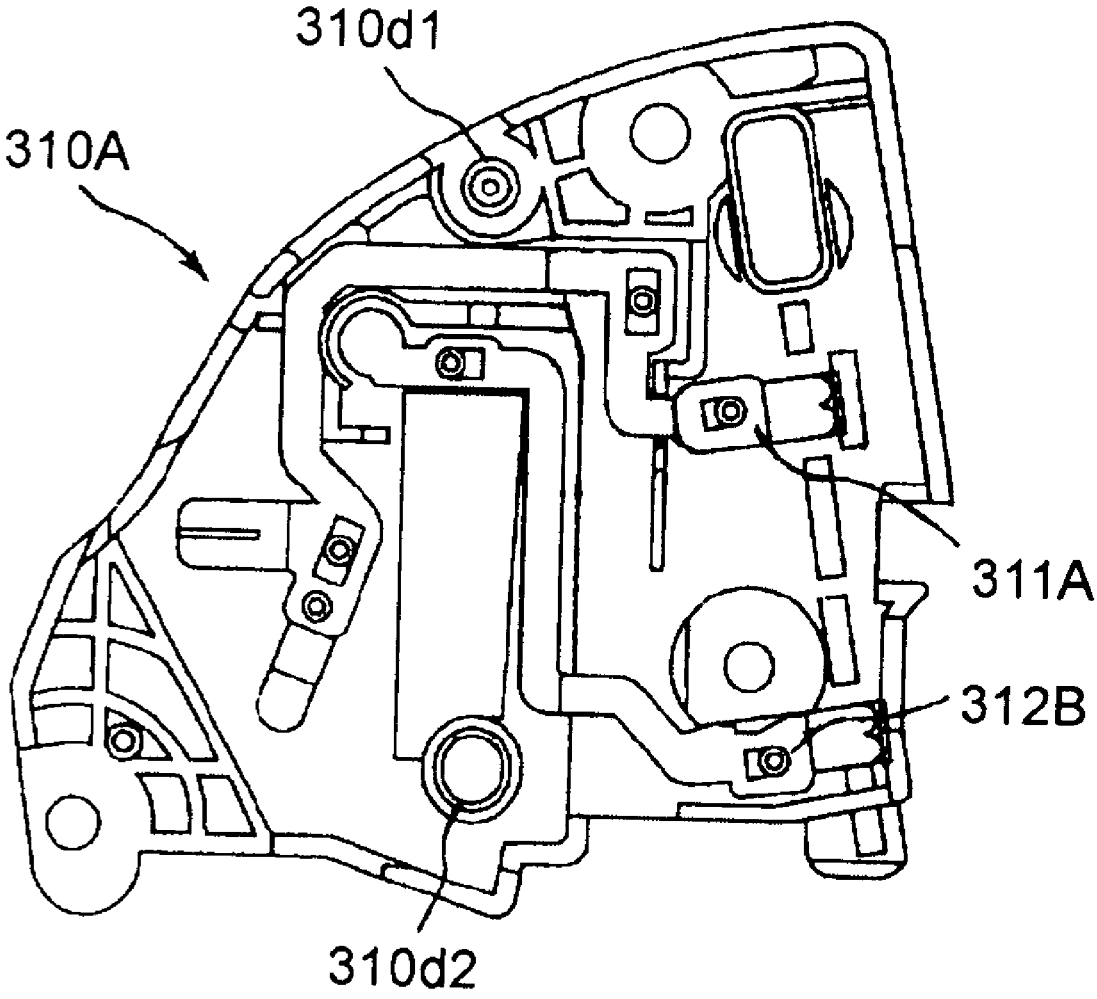
FIG. 22 is a perspective view of the side cover in FIG. 20, showing the inward side thereof.
Figure 23:
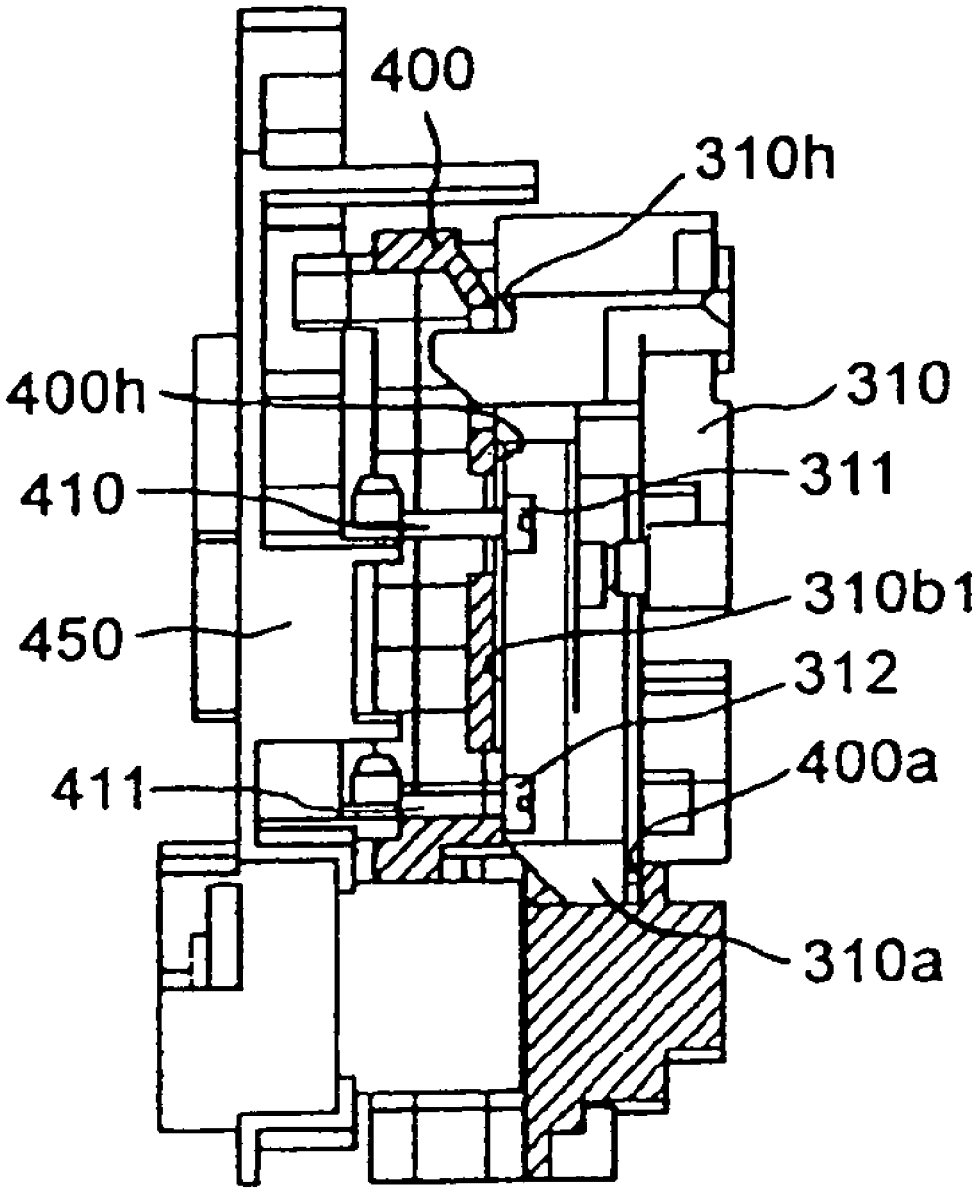
FIG. 23 is a sectional view of the lengthwise end of the rotary device, on the side from which the rotary device is not driven, and the corresponding lengthwise end of a development cartridge, in the second embodiment of the present invention, showing in detail, how the development cartridge is positioned relative to the rotary in terms of the lengthwise direction of the development cartridge, and how the electrical contact point on the main assembly side is connected to the electrical contact point on the development cartridge side.

Referring to FIG. 22, in this embodiment, the development bias electrical contact 311A having the development bias electrical contact point 311 is wired so that as the side cover 310A is attached to the development cartridge main assembly, the development bias electrical contact 311A becomes connected to the developing member (development roller) 305 and developer coating member (toner supplying roller) 304 of the development cartridge 4. With this structural arrangement, it is possible to apply the development bias and coating member bias to the development roller 305 and toner supplying roller 304, respectively. The development bias electrical contact 312A having the development bias electrical contact point 312 is wired so that as the side cover 310A is attached to the development cartridge main assembly, the development bias electrical contact 312A becomes electrically connected to the developer amount regulating member (development blade) 332 of the development cartridge 4. With this structural arrangement, it is possible to apply the developer amount regulating bias voltage to the development blade 332.

The structure of the lengthwise end surface, on the side from which the development cartridge 4 is driven, of the development cartridge 4, that is, the outward surface of the side cover 310B, is the same as that in the first embodiment shown in FIG. 5.

In order to assure that the development cartridge 4 is mounted in the predetermined position, the end guide 310*b*1 is given a length equal to approximately half the radius of the arcuate surface of the development cartridge 4. In other words, the end guide 310*b*1 is long enough for a plurality of electrical contact points to be attached to the end guide 310*b*1. Therefore, the plurality of electrical contact points can be attached to the end guide 310*b*1 so that all of the plurality of electrical contact points are positioned at the same level. Therefore, it is possible to keep the contact pressure stable.

The operation for inserting the development cartridge 4 in this embodiment into the rotary device 40 is the same as that for inserting the development cartridge 4 in the first embodiment into the rotary 40.

Next, referring to FIG. 15 which is a sectional view of the development cartridge 4 having been locked into the predetermined position, as the development cartridge 4 is driven by the force from the image forming apparatus main assembly, the first projection 310*h* of the development cartridge 4 comes into contact with the cartridge positioning groove 400*h* of the rotary device 40. As a result, a predetermined distance is secured between the development bias electrical contact points 410 and 411 of the image forming apparatus main assembly and the development cartridge 4.

On the other hand, the lengthwise movement of the development cartridge 4 in the direction opposite to the direction in which the development cartridge 4 is pressed as the development cartridge 4 is driven is regulated as the end surface of the second projection 310*a* attached to the development cartridge 4 comes into contact with the bottom surface of the development cartridge movement regulating groove 400*a* of the rotary disk 400 of the image forming apparatus main assembly.

In other words, also in this embodiment, the member 400*a* for regulating the movement of the development cartridge 4 in the direction opposite to the direction in which the development cartridge 4 is pressed as the development cartridge 4 is driven, is provided for regulating the movement of the development cartridge 4 when the first projection 310*h* of the development cartridge 4 fails to satisfactorily come into contact with the cartridge positioning groove 400*h* of the rotary 40 because of irregularities in the driving of the development cartridge 4. Therefore, the fluctuation of the distances between the development bias electrical contact points 410 and 411 of the image forming apparatus main assembly and the development bias electrical contact points 311 and 312, respectively, of the development cartridge 4 can be reduced.

Further, the two development bias electrical contact points 410 and 411 of the image forming apparatus main assembly, more specifically, the supporting plate 450 of the rotary device 40 are in the form of a coil spring, and the contacts 410 and 411 are fixed to the supporting plate 450 of the rotary device 40.

To these two development bias electrical contact points 410 and 411 of the image forming apparatus main assembly, the development bias electrical contact points 311 and 312 of the development cartridge 4 are electrically connected.

The development bias electrical contact points 311 and 312 are attached to the end guide 310*b*2 on the side from which the development cartridge 4 is not driven, at the same heights from the base of the guide 310*b*2. Therefore, the error in the distances between the positioning projection 310*h* and the contact points 311 and 312 can be limited to the variations in the position of a single component resulting from the tolerance of the single component.

The positional relationships between the development bias electrical contact points 410 and 411 and development bias electrical contact points 311 and 312, respectively, are as follows: there are only the rotary supporting plate 450, development bias electrical contact point 410, rotary device 40, and the contact point 311 of the development cartridge 4, in that order from the outward side of the rotary 40.

Therefore, the number of the components between the pair of development bias electrical contact points 410 and 411 and the pair of development bias electrical contact points 311 and 312 is substantially smaller compared to that in accordance with the prior art; the overall error in positional relationship resulting from the sum of the tolerances of the components between the pair of development bias electrical contact points 410 and 411 and the pair of development bias electrical contact points 311 and 312, respectively, can be minimized. Therefore, it is easier to keep a predetermined distance between the two pairs of contact points. Therefore, the development bias can be reliably applied.

Further, the positioning of the development cartridge 4 in its lengthwise direction, and the application of the development bias, are accomplished on the rotary disk 400A side, that is, the side apart from the driving force input portion having the rotary disc on the side from which the development cartridge 4 is not driven, in other words, on the side opposite to the driving force input portion having the driving force input gear 307. Therefore, the distances between the pair of development bias electrical contact points 410 and 411 and the pair of development bias electrical contact points 311 and 312, respectively, are less likely to be affected by the minute displacement of the development cartridge 4 in its widthwise direction caused by the driving force; it is easier to keep the pair of development bias electrical contact points 410 and 411 and the pair of development bias electrical contact points 311 and 312 at the predetermined locations. Therefore, it is possible to reliably apply the development bias.

Further, in order to prevent the resinous portion of the development cartridge 4 in the adjacencies of the development bias electrical contact points 311 and 312 from being damaged, it is necessary to attach the development bias electrical contact points 311 and 312 to the portions of the development cartridge 4, which is raised from the surfaces 310*i* and 310*j*.

In this embodiment, therefore, the development bias electrical contact points 311 and 312 are attached to the top surface of the guide rib 310*b*, which is located more outward from the main assembly of the development cartridge 4, in the lengthwise direction of the development cartridge 4, than the surfaces 310*i* and 310*j*. Therefore, it is possible to eliminate the need for providing the surfaces 310*i* or 310*j* of the development cartridge 4 with an additional raised portion to which the development bias electrical contact points 311 and 312 are to be attached, contributing thereby to space saving. Further, without the additional raised portion on the surface 310*i* and/or 310*j*, the surfaces 310*i* and 310*j* do not have such a portion that hangs up during the insertion of the development cartridge, making it possible to smoothly insert the development cartridge, improving in turn the efficiency and ease with which the development cartridge is mounted or dismounted by a user.

As described above, in this embodiment, the development cartridge 4 is provided with the positioning rib, whereas the rotary device 40 of the image forming apparatus main assembly is provided with the groove for positioning the development cartridge 4 in the lengthwise direction of the development cartridge 4. Therefore, it can be made easier to keep constant the distances between the pair of development bias electrical contact points 410 and 411 and the pair of development bias electrical contact points 311 and 312, respectively. Therefore, the development bias can be reliably applied.

Also in this embodiment, the positioning of the development cartridge 4 in its lengthwise direction, and the application of the development bias, are accomplished from the side from which the development cartridge 4 is not driven, that is, from the side apart from the portion of the development cartridge 4 through which the driving force is inputted into the development cartridge 4. Therefore, the positioning of the development cartridge 4 and application of the development bias are less likely to be affected by the displacement of the development cartridge 4 in the widthwise direction of the development cartridge 4 by the driving force, making it possible to reliably apply the development bias. Further, this embodiment makes it possible to dispose a plurality of development bias electrical contact points on the guide rib 310*b*, at the same heights from the surface from which the guide rib 310*b* projects. Therefore, it is possible to equalize the plurality of development bias electrical contact points in terms of the pressure applied thereto, making it possible to reliably apply stable development bias.

Also in this embodiment, the development bias electrical contact points 311 and 312 are attached to the guide rib 310*b* of the development cartridge 4. Therefore, the resinous portions of the development cartridge 4 in the adjacencies of the electrical contact points are not damaged when the rotary device 40 is rotated. Therefore, it is unnecessary to set up the development bias electrical contact points one step higher than the adjacencies of the contact points; it is possible to reduce the development cartridge 4 in size. Also with the above described structural arrangement, the development cartridge 4 does not have such a projecting portion that hangs up when mounting or dismounting the development cartridge 4. Therefore, it is possible to smoothly mount or dismount the development cartridge 4, improving the efficiency with the development cartridge 4 is operated by a user.

Figure 20:
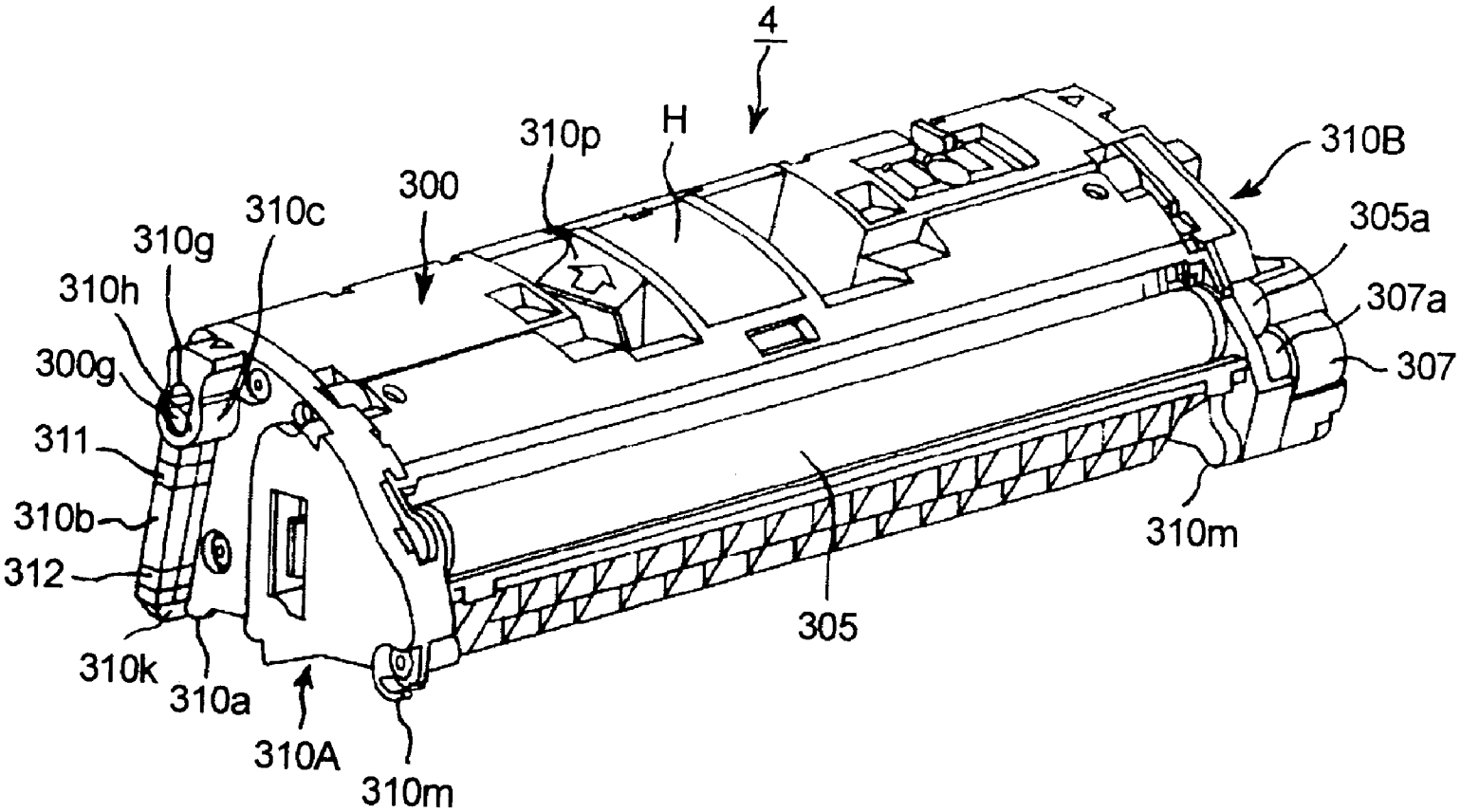
FIG. 20 is a perspective view of the development cartridge in a second embodiment of the present invention.
Figure 21:
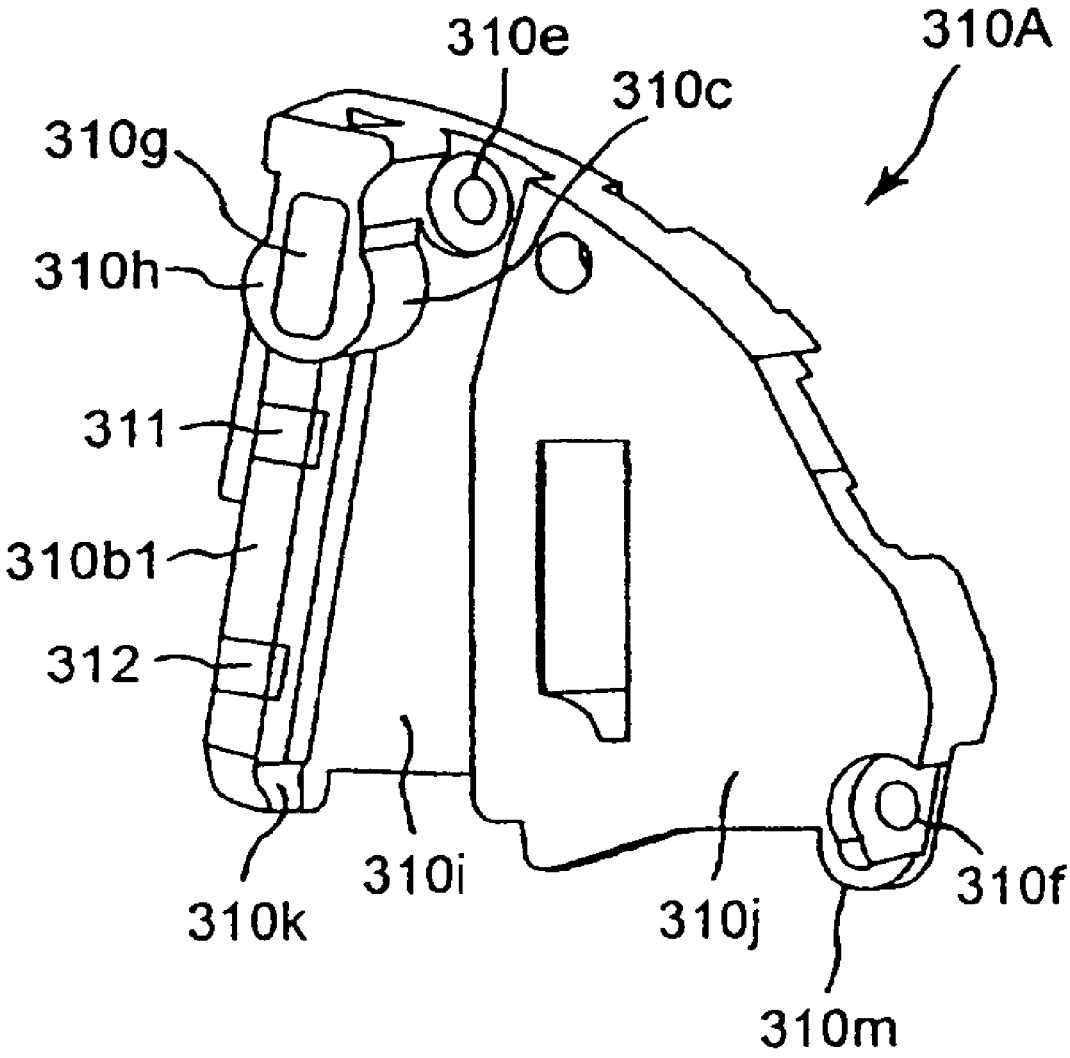
FIG. 21 is a perspective view of one of the side covers of the development cartridge in FIG. 20, showing the outward side of the side cover.

Referring to FIGS. 4 and 20, as is understood from the above description, according to the first and second embodiments of the present invention, the development cartridges 4 are provided with the positioning ribs, each of which is an integral combination of the guide rib 310*b* and positioning projection 310*h*. Further, the portion 310*a* of the development cartridge 4 for regulating the position of the development cartridge 4 in the lengthwise direction of the development cartridge 4 is on the imaginary extension of the positional rib. In other words, the positioning portion 310*h*, the guiding portion 310*b*, and the portion 310*a* for regulating the position of the development cartridge 4 in the lengthwise direction are in alignment.

Therefore, it is possible to precisely position the positioning portion 310*h*, the electrical contacts on the guide rib 310*b*, and the portion 310 *a* for regulating the position of the development cartridge 4 in terms of its lengthwise direction, relative to the image forming apparatus main assembly. In other words, the electrical contacts can be precisely positioned in the image forming apparatus, making it possible to reliably supply the development cartridge 4 with stable bias.

Also in the first and second embodiments, the positioning portion 310*c* having the cartridge positioning portion 310*h* shown FIGS. 4 and 20 functions as the axle, about which the development cartridge 4 pivots. Further, when the development cartridge in the rotary device 40 is moved to the development position, the electrical contact point 311 (312) is not excessively pressed upon the electrical contact point 410 (411) fixed to the inward side of the image forming apparatus main assembly, and therefore, can be smoothly moved into the position in which the bias is supplied. Further, while the development cartridge 4 is moved into the development position, the pressure catching portion 310*k* of the guide rib 310*b* comes under the pressure generated by the resiliency of the spring 53 attached to the rotary device and the pressure generated by the rotational moment generated as the development roller 305 is rotationally driven, and the projection 310*m* is pressed upon the surface of the receptacle 400*e* shown in FIG. 13. As a result, the development cartridge 4 regains its development attitude, in which the electrical contact point 311 (312) on the guide rib 310*b* is positioned to supply the bias.

Further, the electrical contact point 311 (312) is disposed on the guide rib 310, and the positioning projection 310*c*, which is aligned with the electrical contact point 311 (312) virtually in the radial direction of the rotary device 40, functions as the axle about which the positioning projection 310*c* pivots. Further, the pressure catching portion 310*k* of the guide rib 310*b* is under the pressure generated by the resiliency of the spring 53, and the development cartridge 4 receives the rotational moment generated as the development roller 305 is rotationally driven. Therefore, it is assured that the electrical contact point 311 (312) remains accurately positioned even after the development cartridge 4 is moved to the development position.

Moreover, the cartridge 4 can be pivoted, making it possible to keep the electrical contact point 311 (312) apart from the electrical contact points 410 (411) of the image forming apparatus main assembly, or keep smaller the contact pressure between the electrical contact point 311 (312) and the electrical contact point 410 (411), until the last moment of the positioning of the development cartridge 4. Therefore, it is possible to reduce the amount by which the electrical contact point 410 (411) of the image forming apparatus main assembly and the electrical contact point 311 (312) are shaved by each other due to the friction caused by the contact pressure.

Figure 25:
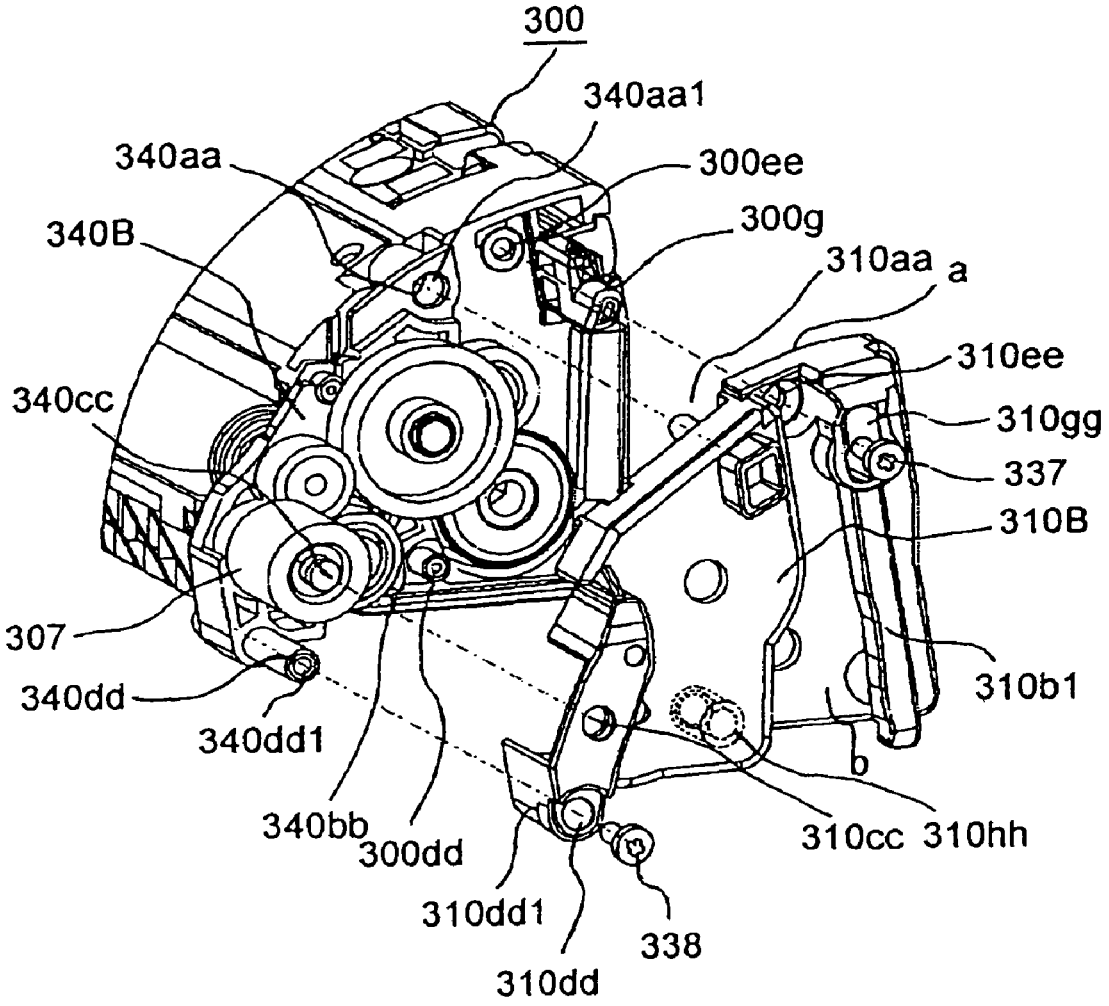
FIG. 25 is a perspective view of one of the lengthwise ends of the cartridge frame, and one of the side covers, showing how the side cover is attached to the lengthwise end of the cartridge frame.
Figure 26:
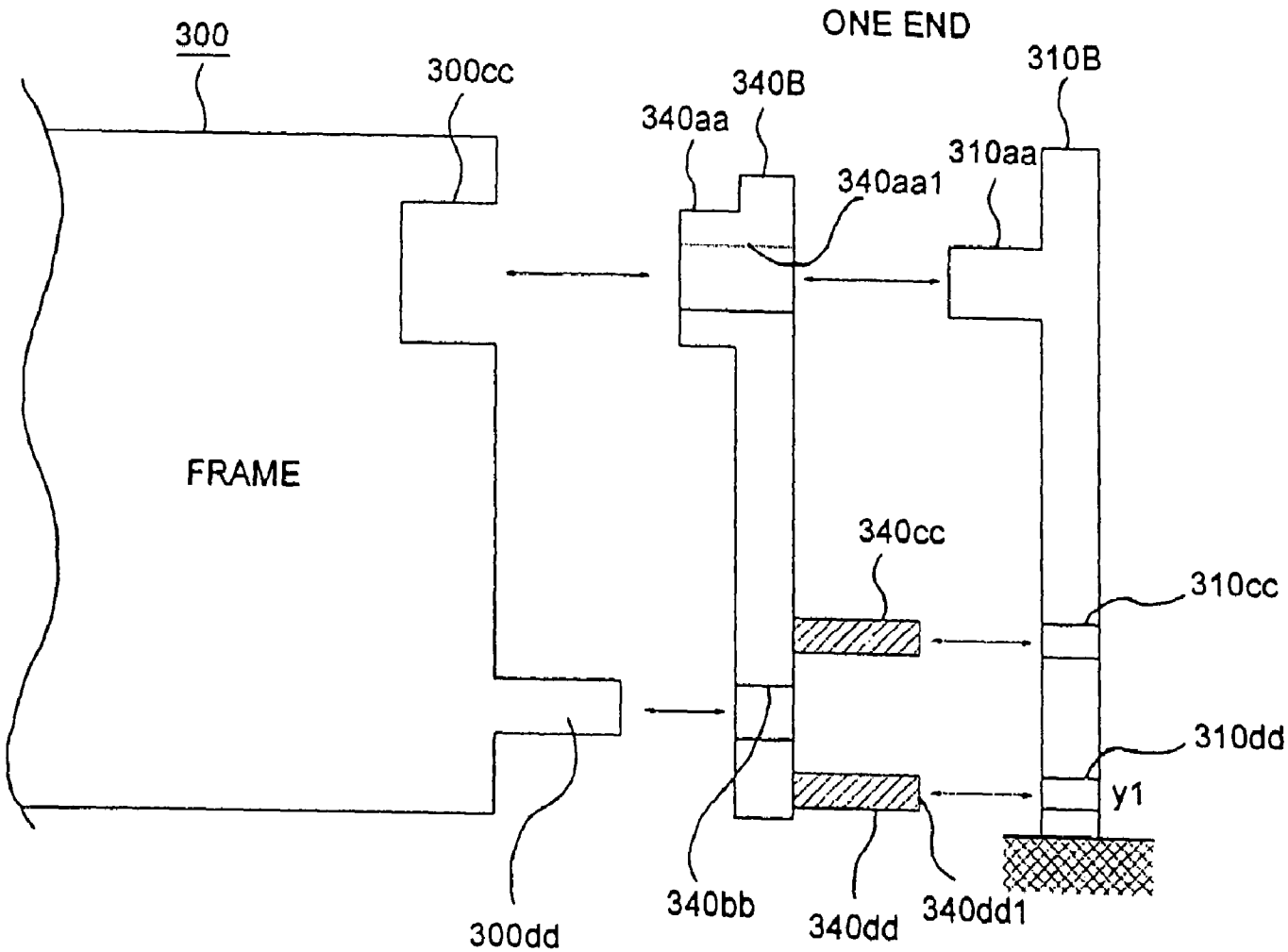
FIG. 26 is a schematic drawing of the cartridge frame, bearing member, and side cover, showing how the bearing member and side cover are attached to the cartridge frame.

Next, referring to FIGS. 24–26, the structural arrangement and method for attaching a bearing member 340B and a side cover 310B to the cartridge frame 300 will be described.

Figure 24:
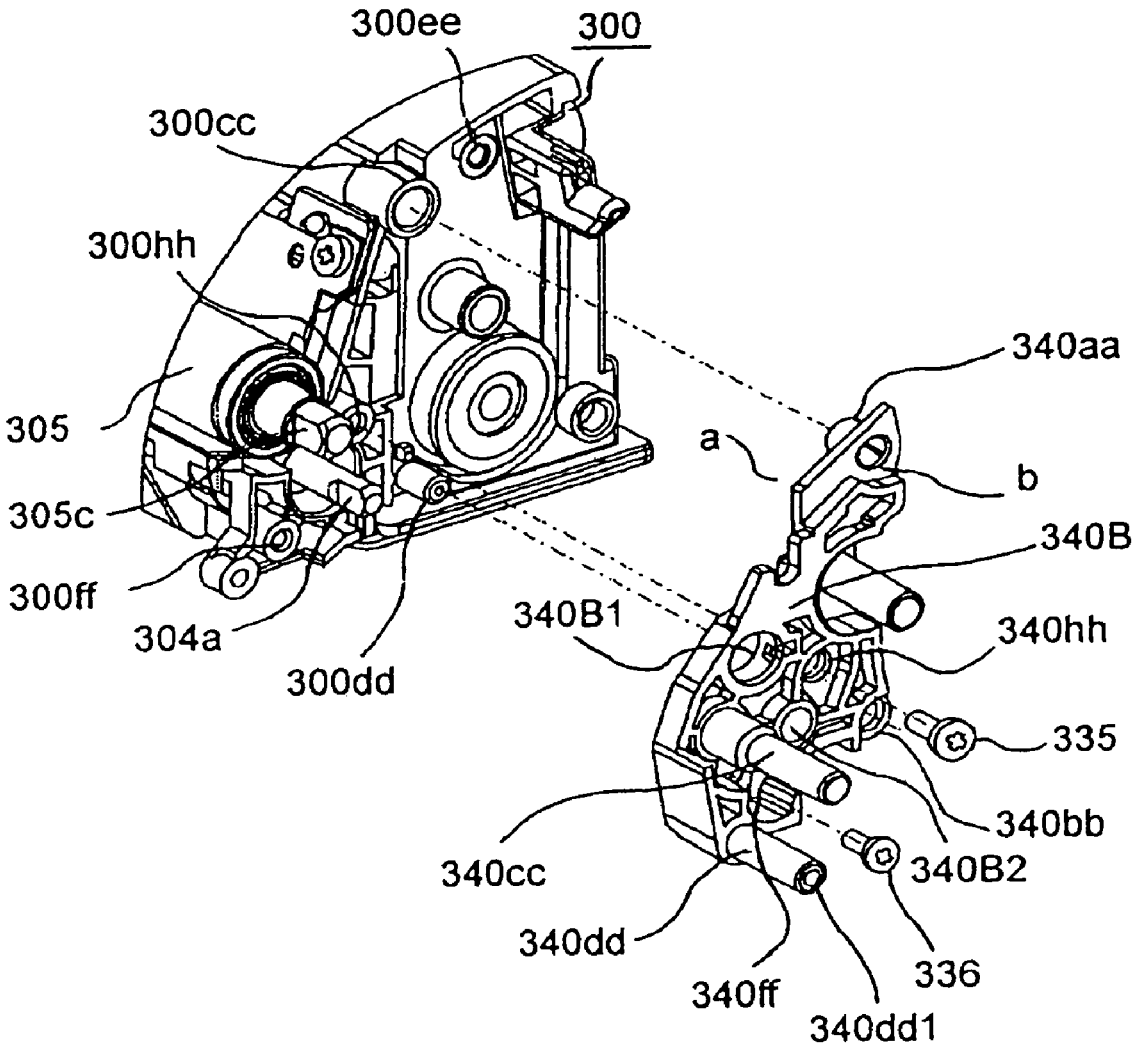
FIG. 24 is a perspective view of one of the lengthwise ends of the cartridge frame, and one of the bearing members, showing how the bearing member is attached to the lengthwise end of the cartridge frame.

FIG. 24 shows one of the lengthwise ends of the cartridge frame 300; FIG. 24 is a perspective view of one of the lengthwise ends of the cartridge frame 300, immediately prior to the attachment of the bearing member 340B to one of the lengthwise ends of the cartridge frame 300, or immediately after the removal of the bearing member 340B from the same lengthwise end of the cartridge frame 300. FIG. 25 is a perspective view of the same lengthwise end of the cartridge frame 300 as the one shown in FIG. 24, to which the bearing member 340B has been attached, and to which the side cover 310B is ready to be attached, or from which the side cover 310B has just been removed. FIG. 26 is a schematic drawing for showing how the bearing member 340B and side cover 3101B are attached to, or removed from, the cartridge frame 300.

First, referring to FIG. 24, the method for attaching the bearing member 340B to the cartridge frame 300 will be described.

The lengthwise end of the cartridge frame 300 shown in FIG. 24 is provided with a groove 300*cc* and a projection 300*dd*, which are on the top and bottom sides of the lengthwise end. The lengthwise end is also provided with screw holes 300*ee*, 300*ff*, and 300*hh*. Designated by reference numbers 305*c* and 304*a* are one end of the shaft of the development roller 305, and one end of the shaft of the toner supply roller 304, respectively.

The bearing member 340B is provided with a bearing member cylinder 340*aa*, which projects from the inward surface "a" of the bearing member 340B, that is, the surface facing the cartridge frame 300. It is also provided with a hole 340*bb*. Further, it is provided with a hole 340B1 in which the aforementioned end 305*c* of the shaft of the development roller 305 is rotationally supported, and a hole 340B2 in which the aforementioned end 304*a* of the shaft of the toner supply roller 304 is rotationally supported. Further, it is provided with a first projection 340*dd* and a second projection 340*cc*, which project from the outward surface b of the bearing member 340B, that is, the surface opposite to the aforementioned surface "a". The second projection 340*cc* supports a gear 307 (helical gear). As the development cartridge 4 is mounted into the image forming apparatus main assembly 100, the gear 307 meshes with a gear (unshown) provided on the image forming apparatus main assembly 100 side, and receives the force for driving the development cartridge 4. The first projection 340*dd* is provided with a screw hole 340*dd*1, which is in the end portion of the first projection 340*dd*.

Next, the side cover 310B, which is attached to one of the lengthwise ends of the cartridge frame 300 will be described.

The side cover 310B is provided with a projection 310*aa*, which projects from the inward surface "a" of the side cover B, that is, the surface which faces the cartridge frame 300. It also is provided with a cylinder 310*hh*, which projects from the inward surface "a". Further, it is provided with a first hole 310*dd*, a second hole 310*cc*, and a screw hole 310*ee*.

Next, the method for attaching the bearing member 340B to the cartridge frame 300 will be described.

First, the bearing member 340B is aligned with the cartridge frame 300 so that as the bearing member 340B is moved toward the cartridge frame 300, the peripheral surface of the cylinder 340*aa* makes contact with the inward surface of the groove 300*cc*, and the projection 300*dd* is put through the hole 340*bb*. Incidentally, the external diameter of the cylinder 340*aa* is virtually the same as the internal diameter of the groove 340*aa*. Thus, as the cylinder 340*aa* is fitted into the groove 300*cc*, the position of the bearing member 340B relative to the cartridge frame 300 becomes fixed. Further, the hole 340*bb* is long and narrow. Therefore, it prevents the bearing member 340B from rotating about the cylinder 340*aa*; it is a so-called "rotation checker". The end 305*c* of the development roller shaft is supported by the bearing member 340B by being put through the hole 340B1, and one end 304*a* of the toner supply roller shaft is supported by the bearing member 340B by being put through the hole 340B2.

Next, the bearing member 340B is screwed to the cartridge frame 300 with screws 335 and 336. The screw 335 is put through the screw hole 340*hh*, and is screwed into the screw hole 300*hh*. The screw 336 is put through the screw hole 340*ff*, and is screwed into the screw hole 300*ff*. As a result, the bearing member 340B is attached to the cartridge frame 300.

Next, referring to FIG. 25, the method for attaching the side cover 310B to one of the lengthwise ends of the cartridge frame 300, to which the bearing member 340B has been attached, will be described.

First, the projection 310*aa* is to be placed in contact with the internal surface 340*aa*1 of the cylinder 340*aa* in the groove 300*cc*, at the same time as the first projection 340*dd* is fitted into the first hole 310*dd*. The first hole 310*dd* is a hole in the end portion of the cylinder 310*dd*1, and the first projection 340*dd* is metallic and cylindrical. It fits into the cylinder 310*dd*1, and at the same time, the second projection 340*cc* fits into the second hole 310*cc*. The second projection 340*cc* is also metallic and cylindrical. The internal diameters of the hole 310*dd* and cylinder are virtually the same as the external diameter of the first projection 340*dd*. The internal diameter of the hole 310*cc* is virtually the same as the external diameter of the projection 340*cc*. However, the projection 310*aa* is loosely in contact with the internal surface of the cylinder 340*aa*. Thus, the positional relationship of the side cover 310B relative to the cartridge frame 300 is fixed by: the portion of the projection 340*dd*, and the portion of the cylinder 310*dd*1, which engage with each other; the portion of the projection 340*dd* and the portion of the hole 310*dd*, which engage with each other; and the portion of the projection 340*cc*, and the portion of the hole 310*cc*, which engage with each other. Further, the contact between the projection 310*aa* and the internal surface 340*aa*1 of the cylinder 340*aa* prevents the side cover 310B from rotating. Incidentally, because the side cover 310B is formed of plastic, it is capable of deforming even if two adjacent portions of the side cover 310B are used to position the side cover 310B relative to the cartridge frame 300. This deforming ability of the side cover 310B is used to absorb the error in the distance between the hole 310*cc* and 310*dd*, which occurs during manufacture.

Next, the side cover 310B is attached to the cartridge frame 300 with screws 337 and 338. The screw 337 is put through the hole 310*ee*, and screwed into a screw hole 300*ee*. The screw 338 is screwed into the screw hole 340*dd*1 in the end of the metallic projection 340*dd* integral with the bearing member 340B.

Through the above described procedure, the side cover 340B is attached to the cartridge frame 300. The cylinder 310*hh* loosely fits in the projection 300*dd* put through the hole 340*bb*.

Figure 28:
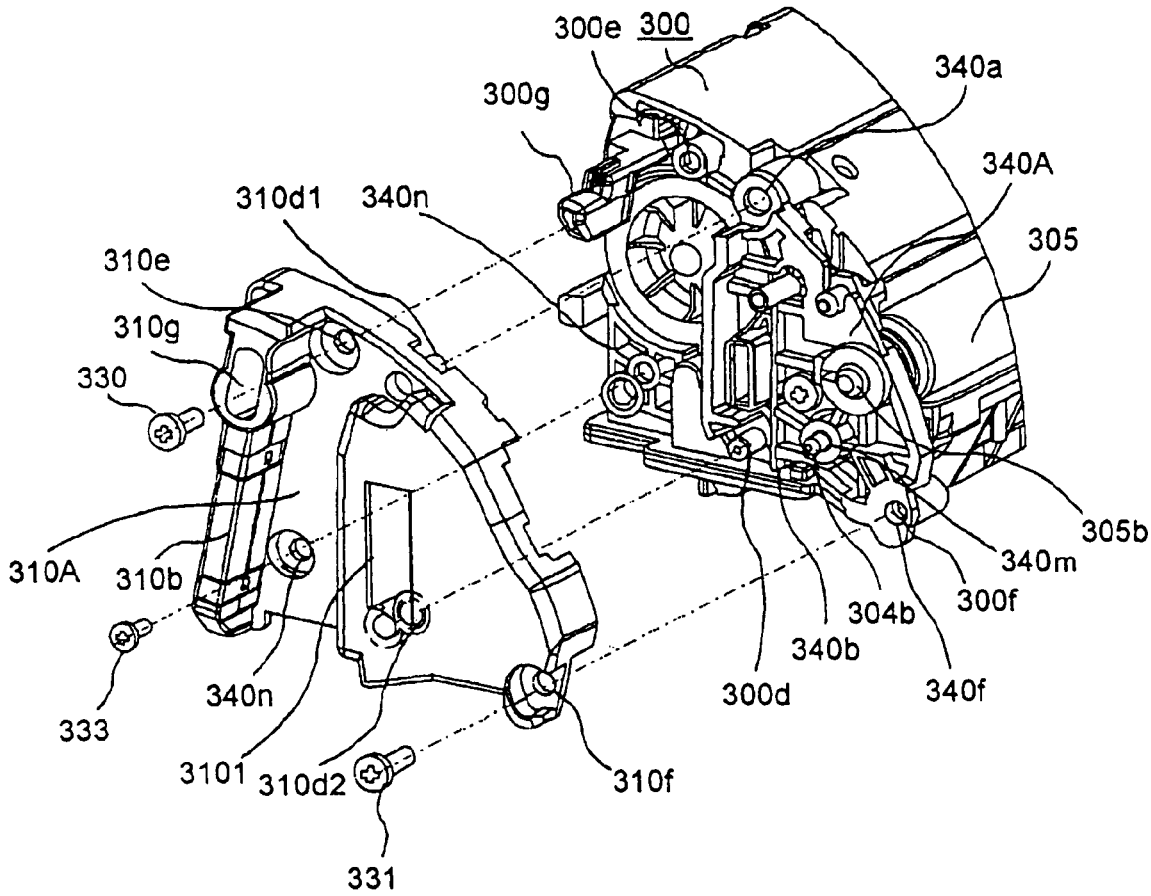
FIG. 28 is a perspective view of the lengthwise end of the cartridge frame, shown in FIG. 27, and the corresponding side cover, showing how the side cover is attached to the cartridge frame.
Figure 29:
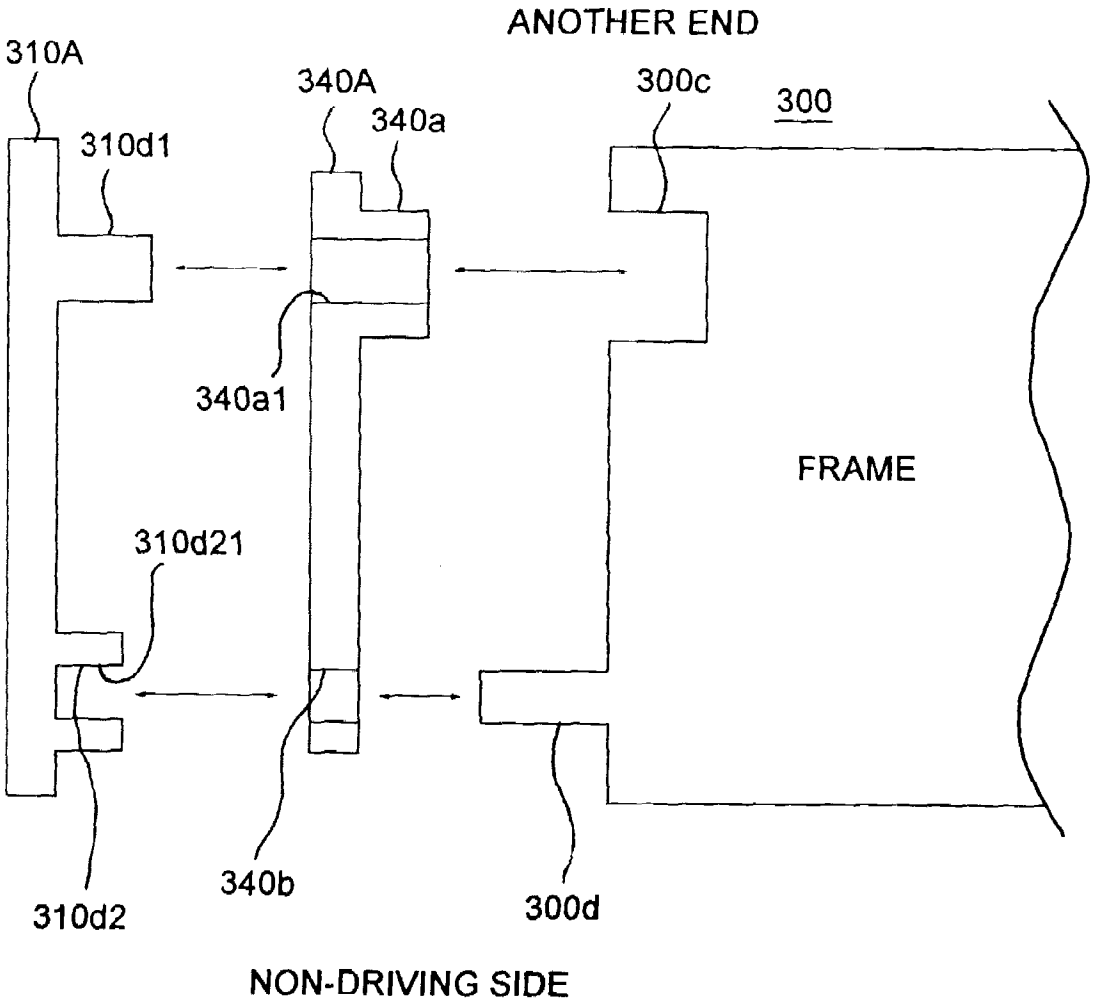
FIG. 29 is a schematic drawing of the cartridge frame, bearing member, and side cover, showing how the bearing member and side cover are attached to the cartridge frame.

Next, referring to FIGS. 27–29, the structural arrangement and method for attaching the bearing member 340A and side cover 310A to the other length end of the cartridge frame 300, will be described.

Figure 27:
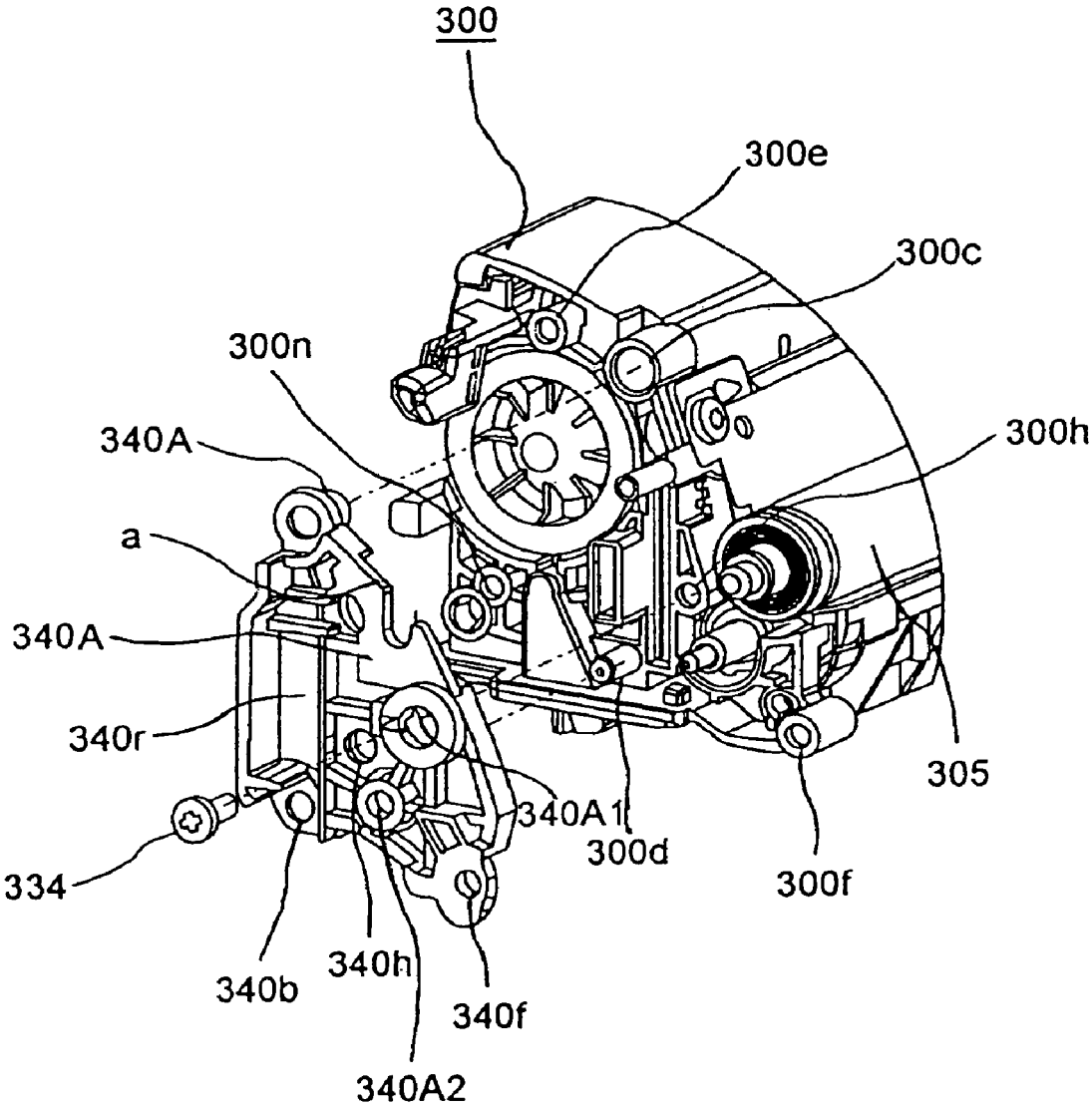
FIG. 27 is a perspective view of the other lengthwise end of the cartridge frame, and the corresponding bearing member, showing how the bearing member is attached to the cartridge frame.

FIG. 27 shows the other lengthwise end of the cartridge frame 300; FIG. 27 is a perspective view of the other lengthwise end of the cartridge frame 300, immediately prior to the attachment of the bearing member 340A to the other lengthwise end of the cartridge frame 300, or after the removal the bearing member 340A from the same lengthwise end of the cartridge frame 300. FIG. 28 is a perspective view of the same lengthwise end of the cartridge frame 300 as the one shown in FIG. 27, to which the side cover 310A is ready to be attached after the bearing member 340A was attached, or from which the side cover 310A has just been removed. FIG. 29 is a schematic drawing for showing how the bearing member 340A and side cover 310A are attached to, or removed from, the cartridge frame 300.

First, referring to FIG. 27, the method for attaching the bearing member 340A to the cartridge frame 300 will be described.

The lengthwise end of the cartridge frame 300 shown in FIG. 27 is provided with a groove 300*c* and a projection 300*d*, which are on the top and bottom sides of the lengthwise end. This lengthwise end is also provided with screw holes 300*e*, 300*f*, 300*h*, and 300*n*. Designated by reference numbers 305*b* and 304*b* are the other end of the shaft of the development roller 305, and the other end of the shaft of the toner supply roller 304, respectively.

The bearing member 340A is provided with a bearing member cylinder 340*a*, which projects from the inward surface "a" of the bearing member 340A, that is, the surface facing the cartridge frame 300. It is also provided with a hole 340*b*, screw holes 340*f* and 340*h*, a hole 340A1 in which the other end 305*b* of the aforementioned development roller shaft is rotationally supported, and a hole 340A2 in which the other end 304*b* of the toner supply roller shaft is rotationally supported. Further, it is provided with a screw hole 340*h* in which the screw 334 is put through, and a screw hole 340*f* in which the screw 336 (not shown) is put through.

Next, the side cover 310A, or the side cover which is attached to the other lengthwise end of the cartridge frame 300, will be described.

The side cover 310A is provided with an end cover projection 310*d*1, which projects from the inward surface "a" of the side cover B, that is, the surface which faces the cartridge frame 300. It also is provided with a cylinder 310*d*2, which projects from the inward surface "a". Further, it is provided with a screw holes 310*e*, 310*f*, and 310*n*.

Next, the method for attaching the bearing member 340A to the cartridge frame 300 will be described.

Incidentally, the cartridge frame 300 is provided with a projection 300*d*.

First, the bearing member 340A is aligned with the cartridge frame 300 so that as the bearing member 340A is moved toward the cartridge frame 300, the peripheral surface of the cylinder 340*a* makes contact with the inward surface of the groove 300*c*, and also so that the projection 300*d* is put through the hole 340*b*. The external diameter of the cylinder 340*a* is virtually the same as the internal diameter of the groove 300*c*. Thus, as the cylinder 340*a* is fitted into the groove 300*c*, the position of the bearing 340A relative to the cartridge frame 300 becomes fixed. Further, the hole 340*b* is long and narrow. Therefore, it prevents the bearing member 340A from rotating about the cylinder 340*a*; it is a so-called "rotation checker". The other end 305*b* of the development roller shaft is supported by the bearing member 340A by being put through the hole 340A1, and the other end 304*b* of the toner supply roller shaft is supported by the bearing member 340A by being put through the hole 340A2.

Next, the bearing member 340A is attached to the cartridge frame 300 with screw 334. The screw 334 is put through the screw hole 340*h*, and is screwed into the screw hole 300*h*. Through this procedure, the bearing member 340A is attached to the cartridge frame 300.

Next, referring to FIG. 28, the method for attaching the side cover 310A to the other lengthwise end of the cartridge frame 300, to which the bearing member 340A has been attached, will be described.

First, the projection 310*a* is to be placed in contact with the internal surface 340*d*1 of the cylinder 340*a* in the groove 300*c*, and at the same time, the projection 340*d* is placed in contact with the internal surface of the cylinder 310*d*2.

The external diameter of the projection 310*d*1 is virtually the same as the internal diameter of the cylinder 340*a*. Further, the internal hole of the cylinder 310*d*2 is long, and small in diameter, and the projection 300*d* loosely fits in the cylinder 310*d*2. Thus, the positional relationship between the side cover 310A relative to the cartridge frame 300 is fixed by the engagement between the projection 310*d*1 and the internal surface 340*a*1 of the cylinder 340*a*, and the side cover 310A is prevented from rotating by the engagement between the projection 300*d* and the internal surface 310*d*21 of the cylinder 310*d*2.

Next, the side cover 310A is attached to the cartridge frame 300 with screws 330, 331 and 333. The screw 330 is put through the hole 310*e*, and screwed into a screw hole 300*e*. The screw 331 is screwed into the holes 310*f*, and 340*f*, and is screwed into the screw hole 300*f* of the cartridge frame 300. The screw 333 is put through the hole 340*n*, and is screwed into the screw hole 300*n* of the cartridge frame 300.

Through the above described procedure, the side cover 340A is attached to the cartridge frame 300.

The above described embodiments can be summarized as follows.

First, the development cartridge 4 removably mountable in the main assembly of an electrophotographic image forming apparatus comprises: the cartridge frame 300; development roller 305 for developing an electrostatic latent image formed on the electrophotographic photoconductive drum 1; groove 300*cc* with which one of the lengthwise ends of the cartridge frame 300 is provided; projection 300*dd* with which the same lengthwise end of the cartridge frame 300 as that with the groove 300*cc* is provided; bearing member 340B which rotationally supports one end 305*c* of the shaft of the development roller 305 disposed in parallel to the lengthwise direction of the cartridge frame 300; cylinder 340*aa* with which the bearing member 340B is provided, and which makes contact with the inward surface of the groove 300*cc*; long and narrow hole 340*bb* with which the bearing member 340B is provided, and through which the projection 300*dd* is put; metallic first projection 340*dd* provided on the outward surface of the bearing member 340B, that is, the surface opposite to the inward surface "a" provided with the cylinder 340*aa*; metallic second projection 340*cc* which is provided on the outward surface "b", and supports the gear to which the driving force is transmitted from the image forming apparatus main assembly when the development cartridge 4 is in the image forming apparatus main assembly 100; first screws 335 and 336 for holding the bearing member 340B to the aforementioned lengthwise end of the cartridge frame 300; side cover 3101B attached to the aforementioned lengthwise end of the cartridge frame 300 in a manner to cover the bearing member 340B; first hole 310*dd* with which the side cover 3101B is provided, and into which the aforementioned first projection 340*dd* is fitted; second hole 310*cc* with which the side cover 310B is provided, and in which the aforementioned second projection 340*cc* is fitted; projection 310*aa* which is provided on the inward surface of the side cover 310B, and is in the hole of the cylinder 340*aa*, being in contact with the internal surface "a" of the cylinder 340*aa* in the groove 300*cc*; second screw 337 which holds the side cover 310B to one of the lengthwise ends of the cartridge frame 300; and third screw 338 which holds the side cover 310B to the first projection 340*dd* of the bearing member 340B.

The development cartridge 4 has the coating roller 304 for coating the developer on the development roller 305, and the bearing member 340B is provided with the hole 340B2 through which one end 304*a* of the shaft of the coating roller 304 projects outward.

The development cartridge 4 has the end guide 310*b*1 which is for guiding the development cartridge 4 when mounting the development cartridge 4 into the image forming apparatus main assembly 100, and which is on the outward surface "b", that is, the surface opposite to the inward surface "a" on which the projection 310*aa* is provided.

The side cover 310B of the development cartridge 4 has a hole 310*gg* into which one end of a cartridge locking portion 300*g* is retractably inserted to prevent the development cartridge 4 from dislodging from the image forming apparatus main assembly 100 after the mounting of the development cartridge 4 into the image forming apparatus main assembly 100.

Further, the development cartridge 4 removably mountable in the main assembly of an electrophotographic image forming apparatus comprises: the cartridge frame 300; development roller 305 for developing an electrostatic latent image formed on the electrophotographic photoconductive drum 1; gear as a driving force receiving member 307 to which the driving force is transmitted from the image forming apparatus main assembly 100 when the development cartridge 4 is in the image forming apparatus main assembly 100; groove 300*c* with which the other lengthwise end of the cartridge frame 300 is provided; projection 300*d* with which the same lengthwise end of the cartridge frame 300 as that with the groove 300*c* is provided; bearing member 340A which rotationally supports the other end 305*b* of the shaft of the development roller 305 disposed in parallel to the lengthwise direction of the cartridge frame 300; cylinder 340*a* with which the bearing member 340A is provided, and which is placed in contact with the inward surface of the groove 300*c*; long and narrow hole 340*b* with which the bearing member 340A is provided, and through which the projection 300*d* on the other side of the cartridge frame 300 is put; first screw 334 which holds the bearing member 340A to the other lengthwise end of the cartridge frame 300; side cover 310A attached to the aforementioned other lengthwise end of the cartridge frame 300 in a manner to cover the bearing member 340A; projection 310*d*1 with which the side cover 310A is provided, and is placed in contact with the internal surface of the cylinder 340*a* of the bearing member 340A in contact with the inward surface of the groove 300*c*; cylinder 310*d*2 with which the side cover 310A is provided, and the internal surface of which is placed in contact with the projection 300*d* put through the hole 340*b* of the bearing member 340A; second screw 330 which holds the side cover 310A to the other lengthwise end of the cartridge frame 300; and third screw 331 which holds both the bearing member 340A and side cover 310A to the other lengthwise end of the cartridge frame 300.

The development cartridge 4 has the coating roller 304 for coating developer on the development roller, and the bearing member 340A is provided with the hole 340A2 through which the other end 304*b* of the shaft of the coating roller 304 projects outward. The bearing member 340A is also provided with a hole 340*r* through which a toner seal "t" is pulled out. The toner seal "t" keeps unsealably sealed the opening (unshown) with which the developer storage portion 303 is provided to release the developer in the developer storage portion 303.

The side cover 310A of the development cartridge 4 has the guide 310*b* which is for guiding the development cartridge 4 when mounting the development cartridge 4 into the image forming apparatus main assembly 100, and which is on the outward surface "b" of the side cover 310A, that is, the surface opposite to the inward surface "a" on which the projection 310*aa* is provided. It also has a hole 3101 through which the toner seal "t" for keeping unsealably sealed the opening of the developer holding storage portion 302 is pulled out.

Further, the side cover 310A of the development cartridge 4 has a hole 310*g* into which one end of a cartridge locking member 300*g* is retractably inserted to prevent the development cartridge 4 from dislodging from the image forming apparatus main assembly 100 after the mounting of the development cartridge 4 into the image forming apparatus main assembly 100.

The method for attaching the side cover 310B to one end of the cartridge frame 300 comprises the following steps:

A shaft supporting step for rotationally supporting one end 305*c* of the shaft of the development roller 305, with the bearing member 340B1; cylinder fitting step for fitting the cylinder 340*aa* of the bearing member 340B into the groove 300*cc* located in one of the lengthwise ends of the cartridge frame 300, in order to attach the bearing member 340B to the cartridge frame 300; a projection placing step for putting the projection 300*dd* with which the same lengthwise end of the cartridge frame 300 as that having the groove 300*c* is provided, through the hole 340*bb* of the bearing member 340B, in order to attach the bearing member 340*b* to the cartridge frame 300; a screwing step for putting the screws 335 and 336 through the holes 340*ff* and 340*hh*, respectively, of the bearing member 340B, and screwing the screws 335 and 336 into the screw holes 300*ff* and 300*hh*, respectively, of the cartridge frame 300, in order to attach the bearing member 340B to the cartridge frame 300; a side cover projection placing step for placing the projection 310*aa* of the side cover 340B in contact with the internal surface 340*aa*1 of the cylinder 340*aa*, in the groove 300*cc* of the cartridge frame 300, of the bearing member 340B; a first fitting step for fitting the metallic first projection 340*dd* of the bearing member 340B into the first hole 310*dd* of the side cover 310B; a second fitting step for fitting the metallic second projection 340*cc* of the bearing member 340B into the second hole 310*cc* of the side cover 310B; a first screwing step for putting the screw 337 through the hole 310*ee* of the side cover 310B, and screwing the screw 337 into the screw hole 300*ee* of the cartridge frame 300, in order to attach the side cover 3101B to the cartridge frame 300 with the use of the screw 337; a second screwing step for putting the screw 338 through the hole 310*dd* of the side cover 3101B, and screwing the screw 338 into the screw hole 340*dd*1 of the first projection 340*dd* of the bearing member 340B, in order to attach the side cover 3101B to the cartridge frame 300 with the use of the screw 338.

The method for attaching the side cover 310B also comprises: the shaft placing step for projecting outward the other end 304*a* of the shaft of the coating roller 304 for coating developer on the development roller 305, through the hole 340B2 of the bearing member 340B when attaching the bearing 340B to the cartridge frame 300.

Further, the method for attaching the side cover 310B comprises: the locking step for making one end of the cartridge locking portion 300*g* for preventing the development cartridge 4 from dislodging from the image forming apparatus main assembly 100, project outward through the locking hole 310*gg* of the side cover 310B when mounting the development cartridge 4 into the image forming apparatus main assembly 100.

In comparison, the method for attaching the side cover 310A, or the other side cover, to the other lengthwise end of the cartridge frame 300 comprises the following steps:

A shaft supporting step for rotationally supporting the other end 305*b* of the shaft of the development roller 305, in terms of the lengthwise direction of the development roller 305, by the bearing member 340A, or the other bearing member; cylinder placing step for placing the cylinder 340*a* of the bearing member 340A, in the groove 300*c* located in the other lengthwise end of the cartridge frame 300, in order to attach the bearing member 340A to the other lengthwise end of the cartridge frame 300; a projection placing step for putting the projection 300*d* of the other lengthwise end of the cartridge frame 300 through the hole 340*b* of the bearing member 340A, in order to attach the bearing member 340A to the cartridge frame 300; a screwing step for putting the screw 334 through the hole 340*b* of the bearing member 340A, and screwing the screw 334 into the screw hole 300*h* of the cartridge frame 300, in order to attach the bearing member 340A to the cartridge frame 300 with the use of screw 334; a projection placing step for placing the projection 310*d*1 of the side cover 310A in contact with the internal surface 340*a*1 of the cylinder 340*a*, in the groove

300*c* of the other lengthwise end of the cartridge frame 300, of the bearing member 310A; a cylinder fitting step for fitting the cylinder 310*d*2 of the side cover 310A around the projection 300*d* of the other lengthwise end of the cartridge frame 300, which has been put through the hole 340*b* of the bearing member 340A; a first screwing step for putting the screw 333 through the hole 310*n* of the side cover 310A, and screwing into the screw hole 300*n* of the cartridge frame 300, in order to attach the side cover 310A to the cartridge frame 300 with the use of the screw 333; and a second screwing step for putting the screw 331 through the holes 310*f* and 340*f* of the side cover 310A and bearing member 340A, respectively, and screwing the 331 into the screw hole 300*f* of the cartridge frame 300, in order to screw the side cover 310A to the cartridge frame 300 with the use of the screw 331.

The method for attaching the side cover 310A to the other lengthwise end of the cartridge frame 300 also comprises the shaft placing step for inserting the other end 304*b* of the shaft of the coating roller 304 for coating developer on the development roller 305, through the hole 340*m* of the bearing member 340A, from the inward side of the hole 340*m*, so that the other end 304*b* sticks out from the outward side of the hole 340*m*, when attaching the bearing member 340A to the cartridge frame 300.

It also comprises: the locking step for making the other end of the cartridge locking portion 300*g* for preventing the development cartridge 4 from dislodging from the image forming apparatus main assembly 100, project outward through the locking hole 310*g* of the side cover 310A after the placement of the development cartridge 4 in the image forming apparatus main assembly 100; and the toner seal placing step for placing the toner seal "t" for keeping unsealably sealed the developer releasing opening (unshown) of the developer storage portion 302, which is holding developer, through the toner seal hole 3101, from the inward side of the toner seal hole 3101, so that the toner seal "t" sticks out from the outward side of the toner seal hole 3101.

Incidentally, the above described cartridge frame 300, bearing members 340A and 340B, and side covers 310A and 310B are made of plastic (for example, styrene). In comparison, the first and second projections 340*cc* and 340*dd* are made of metallic material.

The structure of a development cartridge does not need to be limited to those in the above described embodiments, that is, the structure in which the developing member, and the developer storage portion in which the developer used by the developing member for developing an electrostatic latent image, are integrated into a unit which can be removably mountable in the main assembly of an image forming apparatus. For example, a development cartridge does not need to have a developer storage portion. Further, a development cartridge may integrally comprise other components, members, etc., than a developing member and a developer storage portion, in addition to the developing member and developer storage. A process cartridge means a cartridge in which an electrophotographic photoconductive member and a developing member are integrally disposed, and which can be removably mountable in the main assembly of an image forming apparatus.

According to the above described embodiments of the present invention, before attaching the side covers 310A and 310B to the cartridge frame 300, the bearing members 340A and 340B are attached to the cartridge frame 300, as described above, fixing thereby the positions of the development roller 305 and coating roller 304 relative to the cartridge frame 300. Also according to the above described embodiments, the bearing members 340A and 340B are screwed to the cartridge frame 300, making it possible to attach the bearing members 340A and 340B to the cartridge frame 300 before attaching the side covers 310A and 310B to the cartridge frame 300. In other words, before the side covers 310A and 310B are attached to the cartridge frame 300, the bearing members 340A and 340B will have been fixed to the cartridge frame 300, making it easier to attach the side covers 310A and 310B to the cartridge frame 300.

Also according to the above described embodiments, the projection 310*d*1 perfectly fits into the hollow 340*a*1 of the hollow cylinder 340*a*, accurately positioning the bearing member 340A and side cover 310A relative to the cartridge frame 300. In other words, both the bearing member 340A and side cover 310A are positioned by the same projection, or the projection 310*d* 1, increasing thereby the degree of accuracy with which the bearing member 340A and side cover 310A are positioned relative to the cartridge frame 300. Therefore, the degree of accuracy with which the side cover 310A is attached to the cartridge frame 300 is improved.

Also according to the above described embodiments, the bearing members 340A and 340B are screwed to the cartridge frame 300, increasing thereby the degree of solidity with which the bearing members are attached to the cartridge frame 300. In addition, the side covers 310A and 310B are directly screwed to the cartridge frame 300, increasing thereby the degree of solidness with which the side covers 310A and 310B are attached to the cartridge frame 300. Further, both the bearing member 340A and side cover 310A are screwed to the cartridge frame 300 with a single screw, that is, the same screw. This also adds to the solidity with which the side covers 310A is attached to the cartridge frame 300.

Also according to the above described embodiments, the first projection 340*dd* and second projection 340*cc* are made of metallic material (for example, stainless steel). Moreover, the metallic projection 340*dd* is fitted in the hollow of the hollow cylinder 310*dd*, and the external surface of this hollow cylinder 310*dd* is placed in contact with the image forming apparatus main assembly 100.

Thus, as the side cover 310B is attached to the cartridge frame 300, the metallic projection 340*dd* doubles as a member for reinforcing the side cover 310B. Therefore, even though the position of the development cartridge 4 relative to the image forming apparatus main assembly 100 is fixed by a part of the side cover 310B, the side cover 310B is prevented from deforming, or the deformation of the side cover 310B is minimized. Therefore, the development cartridge 4 is positioned relative to the image forming apparatus main assembly 100 at a higher degree of accuracy.

Further, if an assembly line worker forgets to attach the bearing member 340A to the cartridge frame 300 during the assembly of a development cartridge 4, it becomes impossible to accurately position the side cover 310A relative to the cartridge frame 300. As a result, it is obvious to the assembler that the assembler or someone else forgot to attach the bearing member 340A. This is because the position of the projection 310*d*1 must be fixed by the internal surface of the hollow cylinder 340*a*.

Also according to the above described embodiments, the position of the adjacencies of the positioning portion 310*dd*1 of the side cover 310B, for positioning the side cover 310B relative to the image forming apparatus main assembly 100, is fixed by the metallic shaft 340*dd*, and the side cover 310B is screwed to the cartridge frame 300. Further, the metallic shaft 340*cc* is adjacent the metallic shaft 340*dd*. Therefore, it is difficult for the side cover 310B to deform, increasing thereby the strength (rigidity) of the positioning portion 310*dd*1.

Further, with the provision of the above described projections, the development roller 305 and coating roller 304 can be accurately positioned by the bearing members 340A and 340B alone. Thus, when attaching the side covers 310A and 310B after the attachment of the bearing members 340A and 340B, the bearing members 340A and 340B, and both rollers 304 and 305, will have been accurately positioned, making it easier to attach the side covers 310A and 310B. Therefore, it is easier to assembly a development cartridge 4.

The present invention made it possible to improve the efficiency with which the side cover was attached to the cartridge frame.

The present invention made it possible to improve the accuracy with which the side cover was positioned relative to the cartridge frame when attaching the side cover to the cartridge frame.

The present invention made it possible to increase the degree of solidity with which the side cover was attached to the cartridge frame.

Further, the present invention made it possible to make the metallic projection of the bearing member double as a member for reinforcing the side cover as the side cover was attached to the cartridge frame, preventing the side cover from deforming, or minimizing the deformation of the side cover, even though the position of the development cartridge relative to an electrophotographic image forming apparatus main assembly was fixed by a part of the side cover, when the development cartridge was in the main assembly of the image forming apparatus. Therefore, it was possible to increase the accuracy with which the development cartridge was positioned relative to the main assembly of the image forming apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A developing cartridge detachably mountable to a main assembly of an electrophotographic image forming apparatus, said cartridge comprising:

a cartridge frame;

a developing roller configured and positioned to develop an electrostatic latent image formed on an electrophotographic photosensitive drum;

a one-end frame groove provided at one longitudinal end of said cartridge frame;

a one-end bearing member configured and positioned to rotatably support a shaft provided at one longitudinal end of said developing roller extending in a longitudinal direction of said cartridge frame;

a one-end bearing member cylinder, which is provided on said one-end bearing member and which has an outer surface engaged with an inner surface of said one-end frame groove;

a one-end side cover provided at one longitudinal end of said cartridge frame and configured and positioned to cover said one-end bearing member; and a one-end side cover projection provided inside said one-end side cover and engaged with an inner surface of said one-end bearing member cylinder, which is engaged with the inner surface of said one-end frame groove.

2. A developing cartridge according to claim 1, further comprising an application roller configured and positioned to apply a developer on said developing roller, wherein said one-end bearing member is provided with a shaft projection opening for permitting projection of a shaft therethrough provided on one end of said application roller.

3. A developing cartridge according to claim 1 or 2, further comprising a one-end guide, on an outer surface of said one-end side cover opposite from an inner surface of said one-end side cover on which said one-end side cover projection is provided, configured and positioned to guide said developing cartridge when said developing cartridge is mounted to the main assembly of the apparatus.

4. A developing cartridge according to claim 1, wherein said one-end side cover has a retainer opening through which one end of a retaining portion is retractably projected, the retaining portion being configured and positioned to prevent said developing cartridge from disengaging from the main assembly of the apparatus when said developing cartridge is mounted to the main assembly of the apparatus.

5. A developing cartridge according to claim 1, further comprising:

an other-end frame projection provided at the other longitudinal end of said cartridge frame;

an other-end bearing member configured and positioned to rotatably support an other-end shaft provided at the other longitudinal end of said developing roller extending in the longitudinal direction of said cartridge frame;

an elongated bearing member opening which is provided on said other-end bearing member and configured and positioned to receive said other-end frame projection therethrough;

an other-end side cover provided at the other longitudinal end of said cartridge frame and configured and positioned to cover said other-end bearing member; and an other-end side cover cylinder provided on said other-end side cover and having an inner surface which is engaged with said other-end frame projection penetrating through said bearing member opening.

6. A developing cartridge according to claim 5, further comprising:

an application roller configured and positioned to apply a developer on said developing roller, wherein said other-end bearing member is provided with a shaft projection opening for permitting a shaft provided on an end of said application roller to penetrate therethrough; and a developer accommodating portion configured to accommodate the developer and having a developer supply opening.

7. A developing cartridge according to claim 5, further comprising:

an other-end side cover projection provided inside said other-end side cover and engageable with an inner surface of an other-end bearing member cylinder engaged with an other-end frame groove provided at the other longitudinal end of said cartridge frame; and, an other-end guide, provided on an outer surface of said other-end side cover opposite from an inner surface of said other-end side cover on which said other-end side cover projection is provided, configured and positioned to guide said developing cartridge when said developing cartridge is mounted to the main assembly of the apparatus.

8. A developing cartridge according to claim 7, further comprising on said other-end side cover:

a retainer opening through which one end of a retaining portion configured and positioned to prevent said developing cartridge from disengaging from the main assembly of the apparatus when said developing cartridge is mounted to the main assembly of the apparatus, is retractably projected.

9. A method for mounting a one-end side cover on a cartridge frame, comprising:

a one-end shaft supporting step of rotatably supporting, on a one-end bearing member, a one-end shaft provided at one longitudinal end of a developing roller;

a one-end bearing member cylinder engagement step of engaging a one-end bearing member cylinder provided on the one-end bearing member with a one-end frame groove provided at one longitudinal end of the cartridge frame to mount the one-end bearing member on the cartridge frame; and a one-end side cover projection engaging step of engaging a one-end side cover projection provided on the one-end side cover with an inner surface of the one-end bearing member cylinder engaged with the one-end frame groove.

10. A method according to claim 9, further comprising a shaft projection step of projecting a shaft provided at one end of an application roller configured to apply the developer on the developing roller through a shaft projection opening provided on the one-end bearing member when the one-end bearing member is mounted to the cartridge frame.

11. A method according to claim 10, wherein the cartridge frame is part of a developing cartridge detachably mountable to a main assembly of an image forming apparatus, said method further comprising:

a retainer member projecting step of projecting one end of a retaining member, configured and positioned to prevent the developing cartridge from disengaging from the apparatus, through a retaining member hole, when the one-end side cover is mounted to the cartridge frame, and the developing cartridge is mounted to the main assembly of the image forming apparatus.

12. A method according to claim 9, further comprising:

an other-end shaft supporting step of rotatably supporting, on an other-end bearing member, an other-end shaft provided at another longitudinal end of the developing roller;

an other-end frame projection penetration step of penetrating an other-end frame projection provided at the another longitudinal end of the cartridge frame through a bearing member opening provided in an other-end bearing member to mount the other-end bearing member on the cartridge frame; and an other-end side cover cylinder engaging step of engaging an other-end side cover cylinder of an other-end side cover with the other-end frame projection penetrating through the other-end bearing member opening.

13. A method according to claim 12, further comprising:

a shaft projection step of projecting a shaft provided on an end of an application roller, configured and positioned to apply the developer on the developing roller, through a shaft projection opening provided on the other-end bearing member.

14. A method according to claim 12, wherein the cartridge frame is part of a developing cartridge that is detachably mountable to an image forming apparatus, said method further comprising:

a retainer member projecting step of projecting one end of a retaining member, configured and positioned to prevent the developing cartridge from disengaging from the apparatus, through a retaining member hole, when the one-end side cover is mounted to the cartridge frame, and the developing cartridge is mounted to the main assembly of the apparatus.

15. An electrophotographic image forming apparatus for forming an image on a recording material, and to which a developing cartridge is detachably mountable, comprising:

(i) an electrophotographic photosensitive drum; and (ii) a mounting portion configured and positioned to detachably mount the developing cartridge, which includes a cartridge frame, a developing roller configured and positioned to develop an electrostatic latent image formed on said electrophotographic photosensitive drum, a one-end frame groove provided at one longitudinal end of the cartridge frame, a one-end bearing member configured and positioned to rotatably support a one-end shaft provided at one longitudinal end of the developing roller extending in a longitudinal direction of the cartridge frame, a one-end bearing member cylinder, which is provided on the one-end bearing member and which has an outer surface engaged with an inner surface of the one-end frame groove, a one-end side cover provided at one longitudinal end of the cartridge frame and covering the one-end bearing member, and a one-end side cover projection provided on an inside of the one-end side cover and engaged with an inner surface of the one-end bearing member cylinder, which is engaged with the inner surface of the one-end frame groove.

16. A developing cartridge according to claim 1, further comprising:

a one-end frame projection provided at said one longitudinal end of said cartridge frame; and an elongated bearing member opening which is provided on said one-end bearing member through which said one-end frame projection penetrates.

17. A developing cartridge according to claim 1, further comprising:

a first metal projection provided on an outer surface of said one-end bearing member opposite from an inner side surface of said one-end bearing member on which said one-end bearing member cylinder is provided;

a first opening provided in said one-end side cover and engageable with said first projection; and a first screw configured and positioned to secure said one-end side cover to said first projection provided on said one-end bearing member.

18. A developing cartridge according to claim 1, further comprising:

a second metal projection which is provided on said one-end bearing member and which supports a gear configured and positioned to receive a driving force from the main assembly of the apparatus when said cartridge is mounted to the main assembly of the apparatus; and a second opening provided in said one-end side cover and engageable with said second metal projection.

19. A developing cartridge according to claim 5, further comprising:

an other-end frame groove provided at the other longitudinal end of said cartridge frame;

an other-end bearing member cylinder, provided on said other-end bearing member, engaged with an inner surface of said other-end frame groove; and an other-end side cover projection provided inside said other-end side cover and engageable with an inner surface of the other-end bearing member cylinder engaged with the inner surface of said other-end frame groove.

20. A method according to claim 9, further comprising:

a one-end frame projection penetration step of penetrating a one-end frame projection provided at the one longitudinal end of the cartridge frame through a bearing member opening provided in the one-end bearing member to mount the one-end bearing member on the cartridge frame.

21. A method according to claim 9, further comprising:

a first projection engagement step of engaging a first metal projection provided on the one-end bearing member with a first opening provided in the one-end side cover; and a one-end side cover screwing step of screwing a screw into a screw bore provided on the first metal projection provided in the one-end bearing member through an opening provided in the one-end side cover.

22. A method according to claim 13, further comprising, a second projection engagement step of engaging a second metal projection provided on the one-end bearing member with a second opening provided in the one-end bearing member.

* * * * *

UNITED STATES PATENT AND TRADEMARK OFFICE

CERTIFICATE OF CORRECTION

PATENT NO. : 7,068,965 B2
APPLICATION NO. : 10/665438
DATED : June 27, 2006
INVENTOR(S) : Yasufumi Yoshino et al.

It is certified that error appears in the above-identified patent and that said Letters Patent is hereby corrected as shown below:

COLUMN 2:
Line 34, “front” should read --from--.
Line 53, “discs,” should read --disks,--.

COLUMN 6:
Line 44, “upused” should read --unused--.

COLUMN 8:
Line 40, “disc” should read --disk--.
Line 45, “discs” should read --disks--.
Line 59, “Referring” should read --Referring to--, and “discs” should read --disks--.

COLUMN 9:
Line 3, “discs 4000” should read --disks 400--.
Line 35, “discs” should read --disks--.
Line 57, “referring” should read --referring to--.
Line 65, “disc,” should read --disk,--.

COLUMN 10:
Line 52, “occur” should be deleted.
Line 57, “disc” should read --disk--.

COLUMN 11:
Line 13, “disc” should read --disk--.
Line 42, “to” should read --to as--.

COLUMN 14:
Line 1, “arid” should read --and--.

UNITED STATES PATENT AND TRADEMARK OFFICE

CERTIFICATE OF CORRECTION

PATENT NO. : 7,068,965 B2
APPLICATION NO. : 10/665438
DATED : June 27, 2006
INVENTOR(S) : Yasufumi Yoshino et al.

It is certified that error appears in the above-identified patent and that said Letters Patent is hereby corrected as shown below:

COLUMN 18:
Line 14, "disc" should read --disk--.

COLUMN 19:
Line 29, "with" should read --with which--.
Line 46, "portion 310 *a*" should read --portion 310*a*--.
Line 54, "shown" should read --shown in--.

COLUMN 20:
Line 48, "cover 3101B" should read --cover 310B--.

COLUMN 22:
Line 38, "removal" should read --removal of--.

COLUMN 23:
Line 11, "a" should be deleted.
Line 24, "bearing" should read --bearing member--.

COLUMN 24:
Line 29, "cover 3101B" should read --cover 310B--.
Line 32, "cover 3101B" should read --cover 310B--.

COLUMN 26:
Line 24, "cover 3101B" should read --cover 310B--.
Line 27, "cover 3101B," should read --cover 310B,--.
Line 29, "cover 3101B" should read --cover 310B--.

COLUMN 27:
Line 13, "the" (1st occurrence) should read --the screw--.

UNITED STATES PATENT AND TRADEMARK OFFICE

CERTIFICATE OF CORRECTION

PATENT NO. : 7,068,965 B2
APPLICATION NO. : 10/665438
DATED : June 27, 2006
INVENTOR(S) : Yasufumi Yoshino et al.

It is certified that error appears in the above-identified patent and that said Letters Patent is hereby corrected as shown below:

COLUMN 28:
Line 17, "310*d* 1," should read --310*d*1,--.
Line 34, "covers" should read --cover--.

COLUMN 29:
Line 13, "assembly" should read --assemble--.

COLUMN 30:
Line 60, "and," should read --and--.

COLUMN 34:
Line 5, "comprising," should read --comprising:--.

Signed and Sealed this

Third Day of February, 2009

John Doll

JOHN DOLL
*Acting Director of the United States Patent and Trademark Office*